US008452223B2

(12) United States Patent
Iwakawa

(10) Patent No.: US 8,452,223 B2
(45) Date of Patent: May 28, 2013

(54) IMAGE FORMING APPARATUS WITH SHEET TRANSPORT CONTROL TIMING CHANGED ACCORDING TO LENGTH OF TRANSPORTED SHEET

(75) Inventor: Tadashi Iwakawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 12/860,055

(22) Filed: Aug. 20, 2010

(65) Prior Publication Data

US 2011/0052291 A1 Mar. 3, 2011

(30) Foreign Application Priority Data

Aug. 26, 2009 (JP) ..... 2009-195863

(51) Int. Cl.
*G03G 15/00* (2006.01)

(52) U.S. Cl.
USPC ..... 399/388; 399/392; 399/395; 399/396

(58) Field of Classification Search
USPC ..... 399/388, 394, 389, 371, 372, 391, 399/392, 393, 395, 396; 271/9.01, 3.18, 4.01, 271/10.01, 226, 227, 229
See application file for complete search history.

(56) References Cited

U.S. PATENT DOCUMENTS

| | | | | |
|---|---|---|---|---|
| 6,577,843 | B2 * | 6/2003 | Akita et al. | 399/396 |
| 6,608,991 | B2 * | 8/2003 | Takada | 399/394 |
| 7,036,811 | B2 | 5/2006 | Howe | |
| 7,237,772 | B2 * | 7/2007 | Kamamura | 271/9.01 |
| 2002/0150413 | A1 | 10/2002 | Hiroshi et al. | |
| 2004/0150154 | A1 | 8/2004 | Howe | |
| 2010/0109229 | A1 | 5/2010 | Iwakawa | |

FOREIGN PATENT DOCUMENTS

| | | | |
|---|---|---|---|
| CN | 1749871 | A | 3/2006 |
| EP | 660195 | A | 6/1995 |
| EP | 2042935 | A | 4/2009 |
| JP | 2001-142373 | | 11/1999 |
| JP | 2002-236431 | A | 8/2002 |
| JP | 2003-280485 | | 10/2003 |

OTHER PUBLICATIONS

Notification of the First Office Action, dated Jul. 20, 2012, issued by the State Intellectual Property Office of the People's Republic of China, in Chinese Application No. 201010265926.5.
Official Communication, dated Mar. 1, 2012, issued by the European Patent Office, in European Patent Application No. 10173911.8.

* cited by examiner

*Primary Examiner* — Judy Nguyen
*Assistant Examiner* — Justin Olamit
(74) *Attorney, Agent, or Firm* — Fitzpatrick, Cella, Harper & Scinto

(57) ABSTRACT

Provided is an image forming apparatus including: an image bearing member bearing a toner image formed by an image forming portion; a transfer part transferring the toner image formed on the image bearing member onto a sheet; a separation/feeding part separating sheets stacked on a sheet stacking member and feeding the sheet while nipping the sheet; and a transport part transporting the sheet fed by the separation/feeding part to the transfer part, in which a transporting operation of the transport part is changed according to a length of the sheet to be transported in a transport direction of the sheet.

5 Claims, 12 Drawing Sheets

FIG. 6

| IMAGE POSITION SHIFT AMOUNT | | SHEET SIZE Ls | | |
|---|---|---|---|---|
| | | $Ls<L1+\alpha$ | $L1+\alpha<Ls<L2$ | $L2<Ls$ |
| BASIC WEIGHT | $52g/m^2-220g/m^2$ | 0mm | 0mm | 0mm |
| | $221g/m^2-256g/m^2$ | 0mm | 0.3mm | 0.5mm |
| | $257g/m^2-300g/m^2$ | 0mm | 0.5mm | 0.8mm |

IMAGE FORMING APPARATUS WITH SHEET TRANSPORT CONTROL TIMING CHANGED ACCORDING TO LENGTH OF TRANSPORTED SHEET

BACKGROUND OF THE INVENTION

1. Field of the Invention

The present invention relates to an image forming apparatus such as a copier or a printer, and more particularly, to an image forming apparatus for forming an image on a sheet by transferring a toner image formed on an image bearing member onto a sheet sent by a registration roller pair.

2. Description of the Related Art

In an image forming apparatus using an electrophotographic process, a visible image borne on a photosensitive member or a transfer member is transferred onto a sheet such as plain paper separated and fed by a separation/feeding part, to thereby obtain a recording image. In the conventional image forming apparatus, a sheet fed from the separation/feeding part is aligned so that a leading edge side thereof is perpendicular to a transport direction thereof by being brought into abutment against a nip portion between a stopped registration roller pair to form a loop. After that, rotation of the registration roller pair is started at a timing that allows a toner image formed on a photosensitive drum to be transferred onto a predetermined position of a sheet.

In recent years, the image forming apparatus is desired to be compatible with various kinds of media and sizes such as basic weights ranging from 52 (g/m$^2$) to 300 (g/m$^2$) (g paper), types ranging from plain paper to coat paper, embossed paper, and intermediates, and sizes ranging from a postcard size to 13×19 (inch). With regard to cardboard (thick sheet), according to the conventional image forming apparatus, a stopped position of a sheet with respect to the nip portion of the registration roller pair varies depending on the thickness of the sheet. This raises a problem that the position of an image on the sheet is caused to change as well. Proposed as a solution thereto is Japanese Patent Application Laid-Open No. 2003-280485 in which an image is formed in a proper position on the sheet by changing a sheet re-feed timing at a registration part or an image write start timing to compensate a displacement amount of the stopped position.

The position of the image formed on the sheet is not formed in the proper position not only because the stopped position of the sheet with respect to the nip portion between the registration roller pair varies depending on the thickness of the sheet but also because of the following reason. That is, there is an image forming apparatus in which the sheet has a trailing side nipped by the separation/feeding part while being transported by the registration roller pair. When the trailing side of the sheet being transported by the registration roller pair is nipped by the separation/feeding part, the nipping of the sheet by the separation/feeding part imposes a load on the registration roller pair during transport. In this case, an actual sheet transport speed differs from a desired sheet transport speed at which the registration roller pair are expected to transport the sheet. If the actual sheet transport speed produced by the registration roller pair differs from the desired sheet transport speed, the image cannot be transferred onto the predetermined position of the sheet, thereby hindering image formation with high precision.

Hereinafter, the above-mentioned problem is exemplarily described in detail. In a recent image forming apparatus for which a higher speed is demanded, a transport speed produced by each of transport roller pairs located downstream of the separation/feeding part is set higher than the transport speed produced at the separation/feeding part, to thereby increase a jam margin by increasing an interval between fed sheets. The registration roller pair and the transport roller pair come to a state of pulling a sheet out of the separation/feeding part under a load imposed by the separation/feeding part. This lowers a transport efficiency (ratio of the actual transport speed to the desired transport speed) exhibited by the registration roller pair and the transport roller pair. In terms of costs, there is an image forming apparatus in which the separation/feeding part driven for the sheet transport is caused to stop after the sheet is received from the separation/feeding part to the transport roller pair located downstream thereof. The registration roller pair and the transport roller pair come to a state of pulling a sheet out of the separation/feeding part under a load imposed by the separation/feeding part, and hence the transport efficiency is degraded. The load imposed by the separation/feeding part also includes a load due to a reverse rotation of a separation roller of the separation/feeding part to which reverse rotation drive is transmitted. The degradation of the transport efficiency due to the load imposed by the separation/feeding part causes a displacement of the image in the position on the sheet particularly during the transport of a cardboard. Among the sheets having a length that may be subjected to a load imposed by the separation/feeding part, the sheet having a larger length in a transport direction receives a larger influence on the displacement of the image in the position on the sheet due to the load imposed by the separation/feeding part.

In the conventional image forming apparatus, in order to solve the above-mentioned problems, a nipping force applied between the registration roller pair is set strong to thereby reduce the degradation of the transport efficiency. This avoids significant degradation of image precision. However, in view of the current compatibility with various kinds of media, the separation/feeding part imposes a heavy load on a thick sheet and a sheet having a surface low in smoothness. In a case of the thick sheet and the sheet having a surface low in smoothness, the transport efficiency exhibited by the registration roller pair is degraded to such an extent as to exert a large influence on the accuracy of the image. In a case where a roller pressure of the registration roller pair is set high so as to prevent the transport efficiency of the registration roller pair from dropping even during the transport of the thick sheet (cardboard), a torque for causing a registration roller to rotate increases and leads to an increase in cost due to upsizing of a motor. Further, in a case where the sheet to be transported is a thin sheet (thin paper), thin coat paper, or an intermediate, an increase in roller pressure leaves an impression on the sheet due to the roller pressure of the registration roller pair.

SUMMARY OF THE INVENTION

The present invention provides an image forming apparatus capable of reducing displacement of an image by preventing an impression due to a registration part from being made on sheets having various sizes without causing an increase in cost due to upsizing of a motor or other such cause.

According to the present invention, there is provided an image forming apparatus including: an image bearing member configured to bear a toner image formed by an image forming portion; a transfer part configured to transfer the toner image formed on the image bearing member onto a sheet; a separation/feeding part configured to separate sheets stacked on a sheet stacking member and to feed the sheet while nipping the sheet; a transport part configured to transport the sheet fed by the separation/feeding part to the transfer part; and a control means configured to control the transport part so that a transporting operation of the transport part is changed according to a length of the transported sheet in a transport direction of the sheet.

According to the present invention, there is provided an image forming apparatus including: an image bearing member configured to bear a toner image formed by an image forming portion; a transfer part configured to transfer the toner image formed on the image bearing member onto a sheet; a separation/feeding part configured to separate sheets stacked on a sheet stacking member and to feed the sheet while nipping the sheet; a transport part configured to transport the sheet fed by the separation/feeding part to the transfer; and a control means configured to control so that a timing to start image formation by the image forming portion is changed according to a length of the transported sheet in a transporting direction.

According to the aspect of the present invention, a satisfactory image can be formed with only a small displacement of the image on the sheet.

Further features of the present invention will become apparent from the following description of exemplary embodiments with reference to the attached drawings.

BRIEF DESCRIPTION OF THE DRAWINGS

FIG. 6 shows an example of a relationship among a basic weight of a sheet, a sheet size, and an image position shift amount.

DESCRIPTION OF THE EMBODIMENTS

First Embodiment

Hereinafter, the accompanying drawings are referenced to describe an image forming apparatus according to a first embodiment of the present invention. Dimensions, materials, and shapes of component parts referred to in the following embodiments and a relative arrangement thereof should be appropriately changed according to a configuration of a device to which the present invention is applied and to various kinds of conditions, and the scope of the present invention is not intended to be limited thereto.

Figure 2:
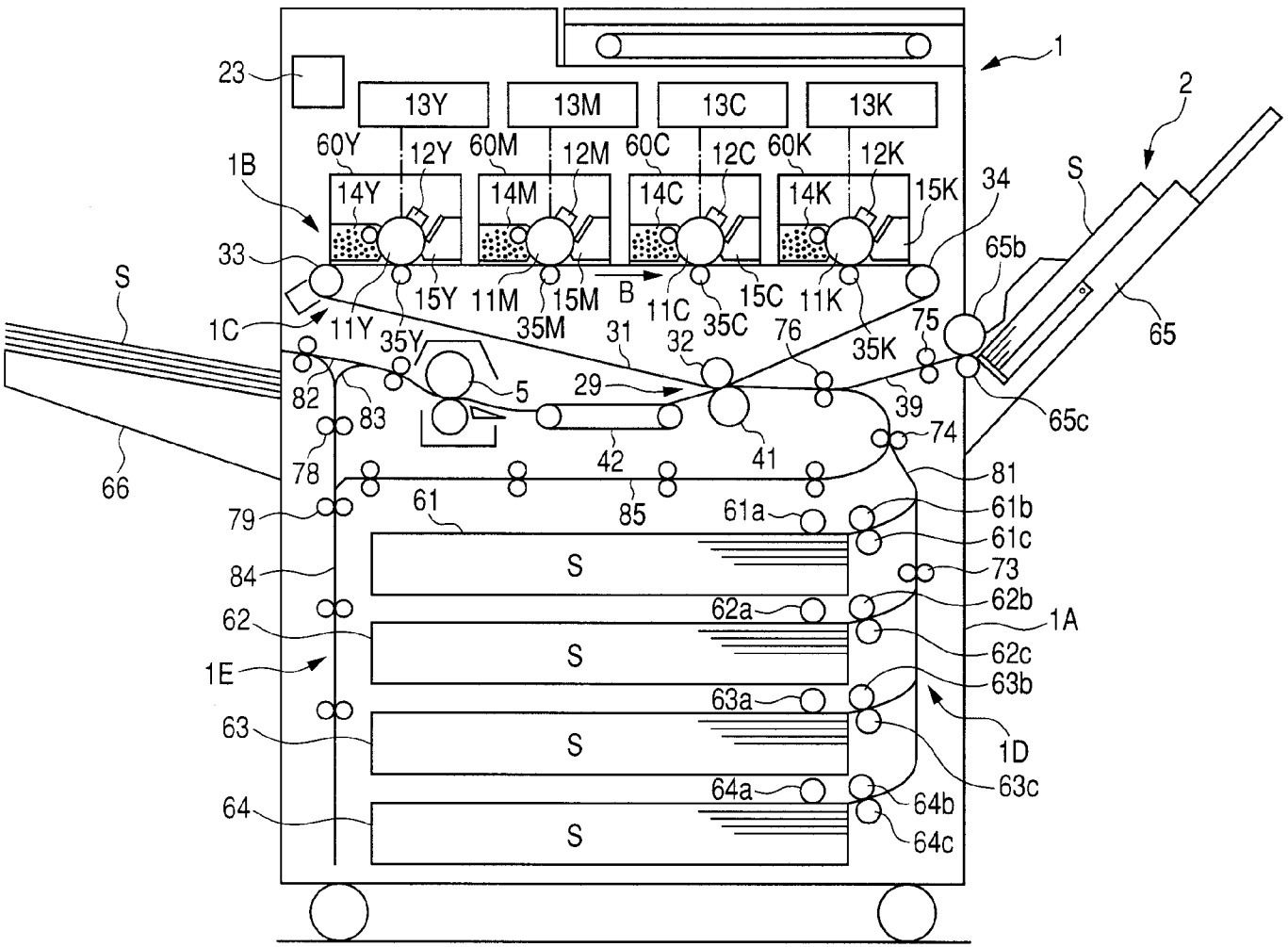
FIG. 2 is a schematic sectional view of the image forming apparatus according to the first embodiment.

FIG. 2 is a schematic sectional view of a color laser printer as an example of the image forming apparatus according to the present invention. A color laser printer main body 1A (hereinafter, referred to as "printer main body") is provided with an image forming portion 1B for forming an image on a sheet S, an intermediate transfer portion 1C, a fixing device 5, a sheet feeding device 1D for feeding the sheet S to the image forming portion 1B, and a manual sheet feeding device 2 for feeding a manual sheet. In addition, the printer main body 1A is provided with a control unit (CPU) 23 for controlling an overall image forming operation of the printer main body 1A. A color laser printer 1 is provided with a re-transport portion 1E for reversing the sheet S having an image formed on a front surface (one surface) thereof to transport the sheet S to the image forming portion 1B again so that an image can be formed on the back surface of the sheet S.

The image forming portion 1B is arranged substantially in a horizontal direction and includes four process stations 60 (60Y, 60M, 60C, and 60K). Those process stations 60Y, 60M, 60C, and 60K form toner images in four colors of yellow (Y), magenta (M), cyan (C), and black (Bk), respectively. The process stations 60 include photosensitive drums 11 (11Y, 11M, 11C, and 11K) serving as photosensitive members driven by stepping motors (not shown), for bearing toner images in four colors of yellow, magenta, cyan, and black, respectively. In addition, the process stations 60 include chargers 12 (12Y, 12M, 12C, and 12K) for uniformly charging surfaces of the photosensitive drums.

The image forming portion 1B includes scanners 13 (13Y, 13M, 13C, and 13K) for irradiating a laser beam onto the photosensitive drums 11 rotating at a constant rate based on an image signal $d_1$ to form an electrostatic latent image corresponding to the image signal $d_1$. The surface of the photosensitive drum 11 is scanned and exposed by laser light on/off-modulated by the image signal and emitted from the scanner 13. Accordingly, the electrostatic latent image corresponding to the image signal is formed on the photosensitive drum 11. The process stations 60 include developing devices 14 (14Y, 14M, 14C, and 14K) for visualizing the electrostatic latent images formed on the photosensitive drums as the toner images by causing toner of yellow, magenta, cyan, and black, respectively, to adhere to the electrostatic latent images. The charger 12, the scanner 13, and the developing device 14 described above are disposed around the photosensitive drum 11 in a rotational direction thereof. The image forming portion 1B includes primary transfer rollers 35 (35Y, 35M, 35C, and 35K) each forming a primary transfer part.

The sheet feeding device 1D is provided in a lower portion of the printer main body and includes sheet feeding cassettes 61, 62, 63, and 64 serving as sheet containing parts for containing the sheets S and sheet feed rollers 61*a*, 62*a*, 63*a*, and 64*a* for successively feeding the sheets S accumulated and contained in the sheet feeding cassettes 61, 62, 63, and 64, respectively. Respectively arranged in downstreams of the sheet feed rollers 61*a*, 62*a*, 63*a*, and 64*a* are sheet feed/transport rollers 61*b*, 62*b*, 63*b*, and 64*b* and separation rollers 61*c*, 62*c*, 63*c*, and 64*c* opposed thereto in contact therewith, for separating the sheets S sent out by the sheet feed rollers 61*a*, 62*a*, 63*a*, and 64*a*, respectively, one by one and feeding the sheets S. The above-mentioned rollers have a retard separation system but may have a friction separation system for pad separation or the like. Arranged in the manual sheet feeding device 2 are a manual feed tray 65 serving as a sheet stacking member for stacking and supporting the sheets S and a sheet feed roller 65*b* for feeding the sheets S stacked on the manual feed tray 65. A separation roller 65*c* is opposed to the sheet feed roller 65*b* in contact therewith. The sheet feed roller 65*b* and the separation roller 65*c* form a separation/feeding part 67 for nipping and feeding the sheets S stacked on the manual feed tray 65 by separating the sheets S one by one. The manual feed tray 65 is provided with a pressure plate 65N urged to the sheet feed roller 65*b* by a pressure spring SPL. A transport roller pair 73 send the sheets S separated and fed from the sheet feeding cassettes 62 to 64 to a vertical transport path 81.

When the image forming operation is started, the sheets S are sent out from the sheet feeding cassettes 61 to 64 by the sheet feed rollers 61*a*, 62*a*, 63*a*, and 64*a*, respectively, and are separated and fed one by one by the sheet feed/transport rollers 61*b*, 62*b*, 63*b*, and 64*b* and the opposed separation rollers 61*c*, 62*c*, 63*c*, and 64*c*, respectively. After that, the sheet S is transported to the registration roller pair 76 via the vertical transport path 81 and the transport roller pair 74. The registration roller pair 76 form a registration part for transporting the sheet S to a transfer position of the secondary transfer part 29 while maintaining synchronization between the toner image (on an image bearing member) on the intermediate transfer belt 31 and the sheet S transported by a separation/feeding part 67. In a case of manual sheet feeding, the sheets S stacked on the manual feed tray 65 are separated and fed one by one by the separation/feeding part 67 formed of the sheet feed roller 65*b* and the separation roller 65*c*, and transported to the registration roller pair 76 via the transport roller pair 75 and the transport path 39. The transport roller pair 75 transport the sheet S separated and fed by the separation/feeding part 67. The intermediate transfer belt 31 forms the image bearing member for bearing the toner image formed by the image forming portion 1B.

The registration roller pair 76 serving as the registration part cause the sheet to be transported to temporarily stop, and then transports the sheet to the secondary transfer part 29 formed of an inner secondary transfer roller 32 and an outer secondary transfer roller 41. The registration roller pair 76 correct skew feeding by bringing the sheet S into abutment against the registration roller pair 76 so as to form a loop and thereby achieving alignment of a leading edge of the sheet S. Further, the registration roller pair 76 transport the sheet S to the secondary transfer part 29 at a timing at which the image is formed on the sheet S, that is, a predetermined timing in synchronization with the toner image borne on the intermediate transfer belt 31 described later. The secondary transfer part 29 forms a transferring part for transferring the toner image formed on the photosensitive drum 11 serving as the image bearing member onto the sheet S in a transfer position described above. The registration roller pair 76 are stopped during the transport of the sheet S. Therefore, bending is formed on the sheet S by bringing the sheet S into abutment against the stopped registration roller pair 76. After that, the leading edge of the sheet is aligned with a nip portion formed between the registration roller pair 76 owing to stiffness of the sheet S. Accordingly, the skew feeding of the sheet S is corrected. When the skew feeding of the sheet S is corrected, the registration roller pair 76 are driven to rotate at a timing at which the toner image formed on the intermediate transfer belt 31 serving as the image bearing member coincides with the leading edge of the sheet S. Hereinafter, it is referred to as "sheet re-feeding" that, after temporarily stopping the sheet S, the registration roller pair 76 start rotation thereof to start the transport of the sheet, and a timing to start the rotation of the registration roller pair 76 is referred to as "sheet re-feed timing".

The intermediate transfer portion 1C includes the intermediate transfer belt 31 driven to rotate in a direction of an array of the process stations 60 indicated by the arrow B in synchronization with a peripheral rotation rate of the photosensitive drum 11. The intermediate transfer belt 31 is looped around a drive roller 33, the inner secondary transfer roller 32 for forming a secondary transfer area across the intermediate transfer belt 31, and a tension roller 34 for applying a moderate tension to the intermediate transfer belt 31 by an urging force of a spring (not shown). Arranged in an inside of the intermediate transfer belt 31 are four primary transfer rollers 35 (35Y, 35M, 35C, and 35K) forming the primary transfer part, for nipping the intermediate transfer belt 31 with the corresponding photosensitive drums 11. The primary transfer rollers 35 are each connected to a transfer bias source (not shown). By applying a transferring bias from the primary transfer roller 35 to the intermediate transfer belt 31, the toner images in the respective colors on the photosensitive drums 11 are successively multi-transferred onto the intermediate transfer belt 31, and a full-color image (full-color toner image) is formed on the intermediate transfer belt 31.

The outer secondary transfer roller 41 is arranged so as to be opposed to the inner secondary transfer roller 32. The outer secondary transfer roller 41 abuts against a lowermost surface of the intermediate transfer belt 31, and nips and transports the sheet S transported by the registration roller pair 76 with the intermediate transfer belt 31. When the sheet S passes through the nip portion between the outer secondary transfer roller 41 and the intermediate transfer belt 31, a bias is applied to the outer secondary transfer roller 41 to thereby secondarily transfer the toner image on the intermediate transfer belt 31 onto the sheet S. The fixing device 5 fixes the toner image formed on the sheet S via the intermediate transfer belt 31 to the sheet S. The sheet S retaining the toner image has the toner image fixed thereto by having heat and pressure applied thereto when passing through the fixing device 5.

The image forming operation of the color laser printer 1 is described. When the image forming operation is started, first in the process station 60Y on the most upstream side in the rotational direction of the intermediate transfer belt 31, the scanner 13Y performs laser irradiation on the photosensitive drum 11Y to form an electrostatic latent image in yellow on the photosensitive drum 11Y. After that, the developing device 14Y develops the electrostatic latent image by using yellow toner to form a yellow toner image. Then, the yellow toner image formed on the photosensitive drum 11Y is primarily transferred onto the intermediate transfer belt 31 in a primary transfer area by the primary transfer roller 35Y to which a high voltage is applied. Then, along with the intermediate transfer belt 31, the toner image is transported to the next primary transfer area defined by the photosensitive drum 11M of the process stations 60M and the primary transfer roller 35M. In the process stations 60M, an image is formed after the process stations 60Y with a delay by a time required for the transport of the toner image.

A subsequent magenta toner image is transferred with the leading edge of the image being aligned with the yellow toner image on the intermediate transfer belt 31. As a result of repeating the same steps, the toner images in four colors are primarily transferred onto the intermediate transfer belt 31 to form a full-color image on the intermediate transfer belt 31. Transfer residual toner that is slightly remaining on the photosensitive drums 11 is collected by photosensitive member cleaners 15 (15Y, 15M, 15C, and 15K) to get ready for the next image formation.

In parallel with the image forming operation for the toner image, the sheets S contained in the sheet feeding cassettes 61 to 64 are sent out by the sheet feed rollers 61*a*, 62*a*, 63*a*, and 64*a*, respectively. The sheets S are separated and fed one by one by the sheet feed/transport rollers 61*b*, 62*b*, 63*b*, and 64*b* and the separation rollers 61*c*, 62*c*, 63*c*, and 64*c*, respectively, and then transported to the registration roller pair 76. In the case of manual sheet feeding, the sheets S stacked on the manual feed tray 65 are separated and fed one by one by the sheet feed roller 65*b* and the separation roller 65*c*, and then transported to the registration roller pair 76 after passing through the transport path 39. In this case, the registration roller pair 76 are stopped, the sheet S is brought into abutment against the stopped registration roller pair 76 to thereby correct the skew feeding of the sheet S. After the skew feeding is corrected, the sheet S is transferred to the nip portion between the outer secondary transfer roller 41 and the intermediate transfer belt 31 by the registration roller pair 76 that start the rotation at the timing at which the toner image formed on the intermediate transfer belt 31 coincides with the leading edge of the sheet. The sheet S is nipped and transported by the outer secondary transfer roller 41 and the intermediate transfer belt 31, and when passing through the nip portion between the outer secondary transfer roller and the intermediate transfer belt 31, has the toner image on the intermediate transfer belt 31 secondarily transferred thereonto by the bias applied to the outer secondary transfer roller 41.

The sheet S onto which the toner image has been secondarily transferred is transported to the fixing device 5 by a pre-fixation transport device 42. The fixing device 5 fuses and fixes the toner image onto the sheet S with a heating effect produced by a heat source, generally a heater or the like in addition to a predetermined pressure applied by the opposed roller, the belt, or the like. A path selection is performed so that the sheet S having the fixed image is transported to a delivery transport path 82 in a case of being delivered onto a delivery tray 66 as it is while being transported to a surface reverse guide path 83 in a case of being subjected to two-side image formation.

In a case where an image is formed on two sides of the sheet S, the sheet S is pulled into a switchback path 84 from the surface reverse guide path 83, has the leading edge and the trailing edge switched over by being subjected to a switchback operation for switching the rotational direction of a second surface reverse roller pair 79 between normal rotation and reverse rotation, and is transported to a two-side transport path 85. After that, the sheet S re-joins with a sheet S for a subsequent job transported by the sheet feed roller 61*a*, 62*a*, 63*a*, or 64*a* or the sheet feed roller 65*b* in synchronization therewith, and is sent to the secondary transfer part 29 serving as the transferring part after passing through the registration roller pair 76 again. An image forming process performed later on the back surface (second surface) is the same as the above-mentioned process that has already been performed on the front surface (first surface). In a case where the sheet S is delivered with the surface reversed, the sheet S is pulled from the surface reverse guide path 83 to the switchback path 84 after passing through the fixing device 5. The pulled sheet S is transported in a direction opposite to the pulling direction by the reverse rotation of a first surface reverse roller pair 78 with the trailing edge of the pulled sheet S regarded as the leading edge, and is delivered to the delivery tray 66.

Figure 1:
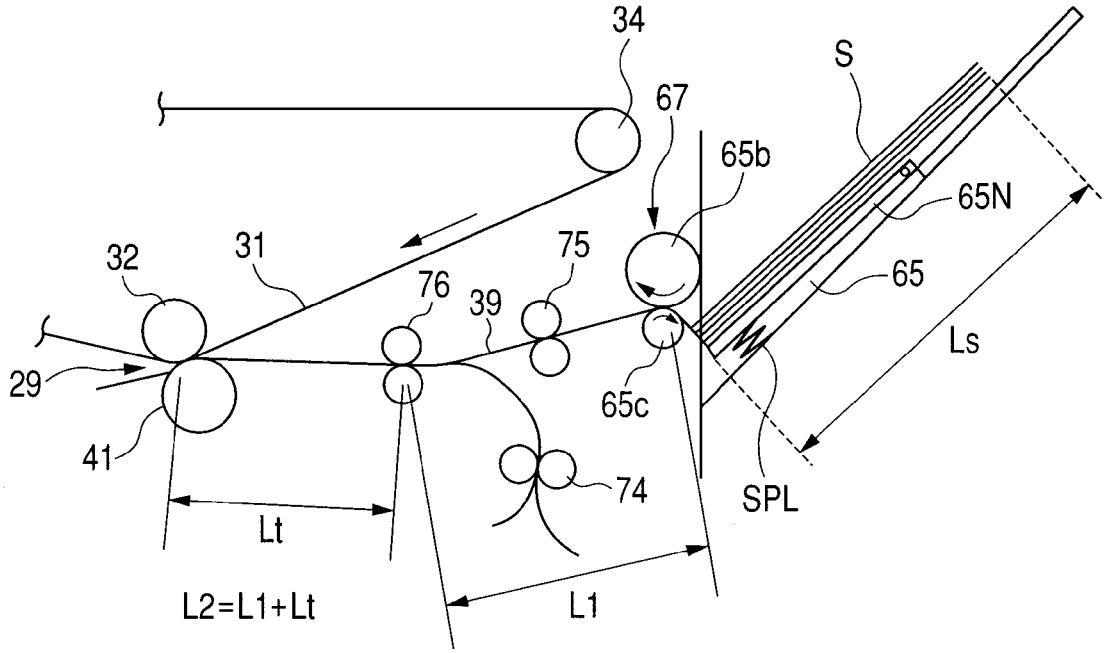
FIG. 1 is a partial sectional view illustrating a separation/feeding part and a registration part that are extracted from an image forming apparatus according to a first embodiment of the present invention.
Figure 3:
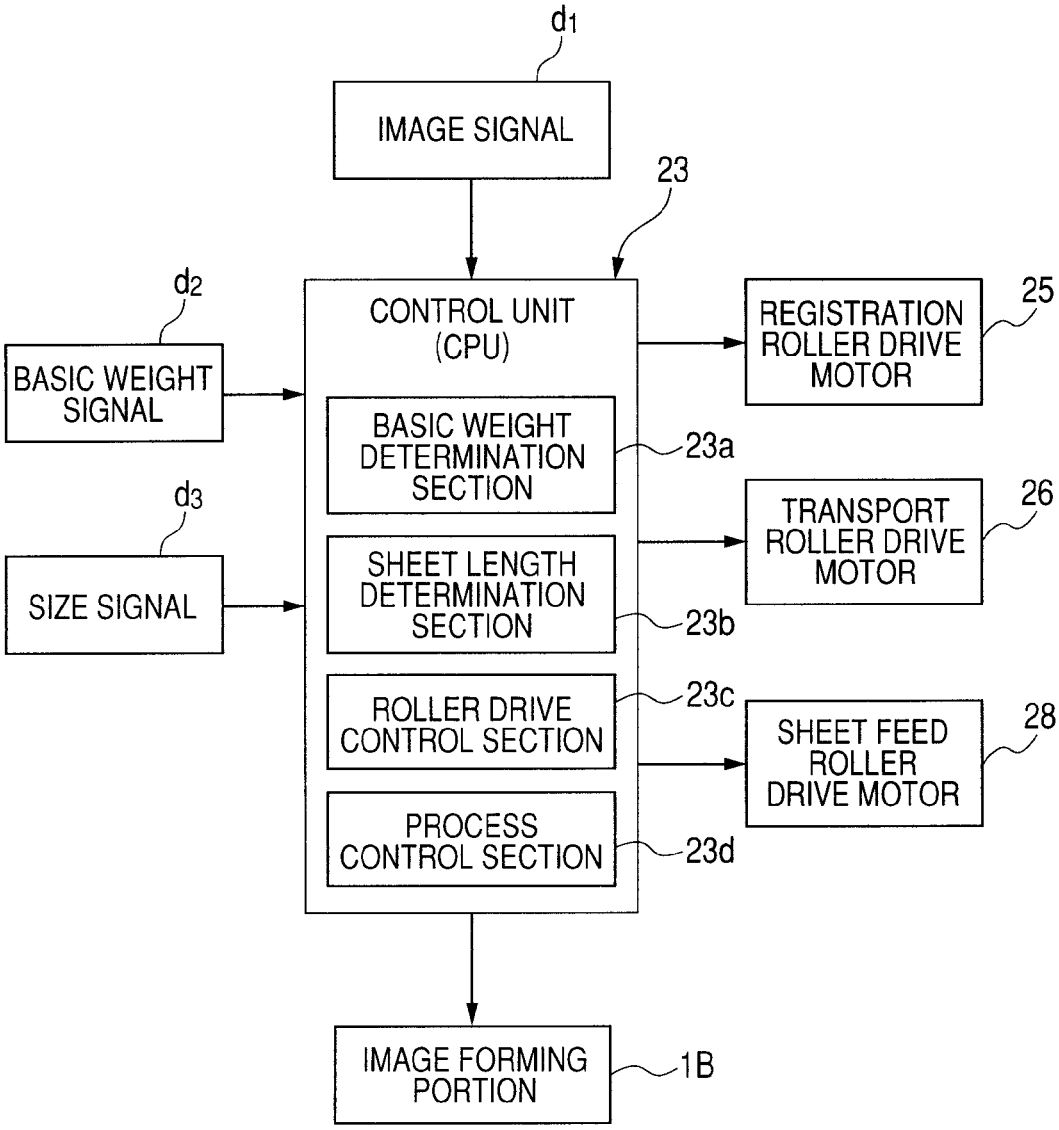
FIG. 3 is a block diagram illustrating a control system of the image forming apparatus.
Figure 4:
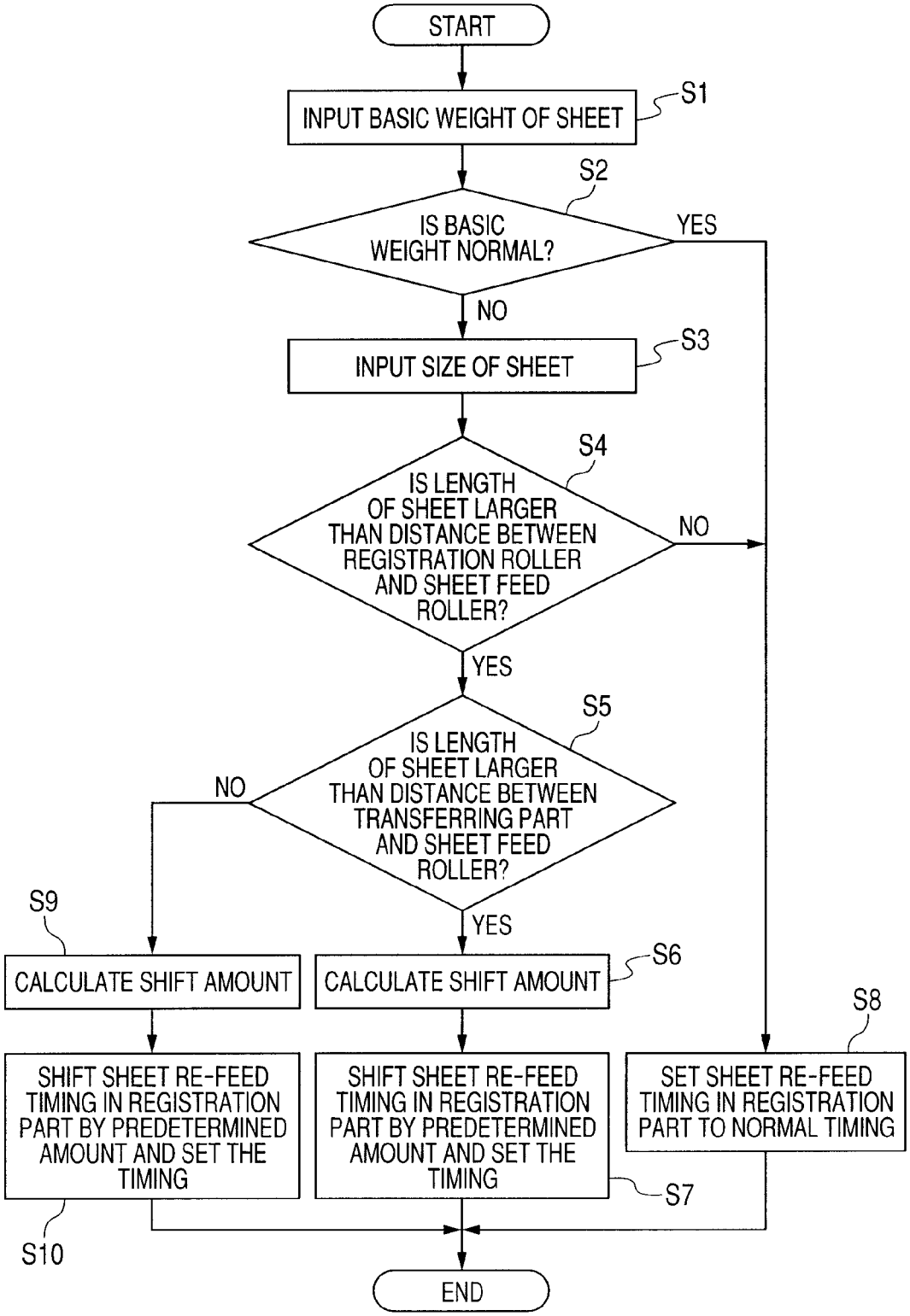
FIG. 4 is a flowchart for describing setting according to the first embodiment.
Figure 5:
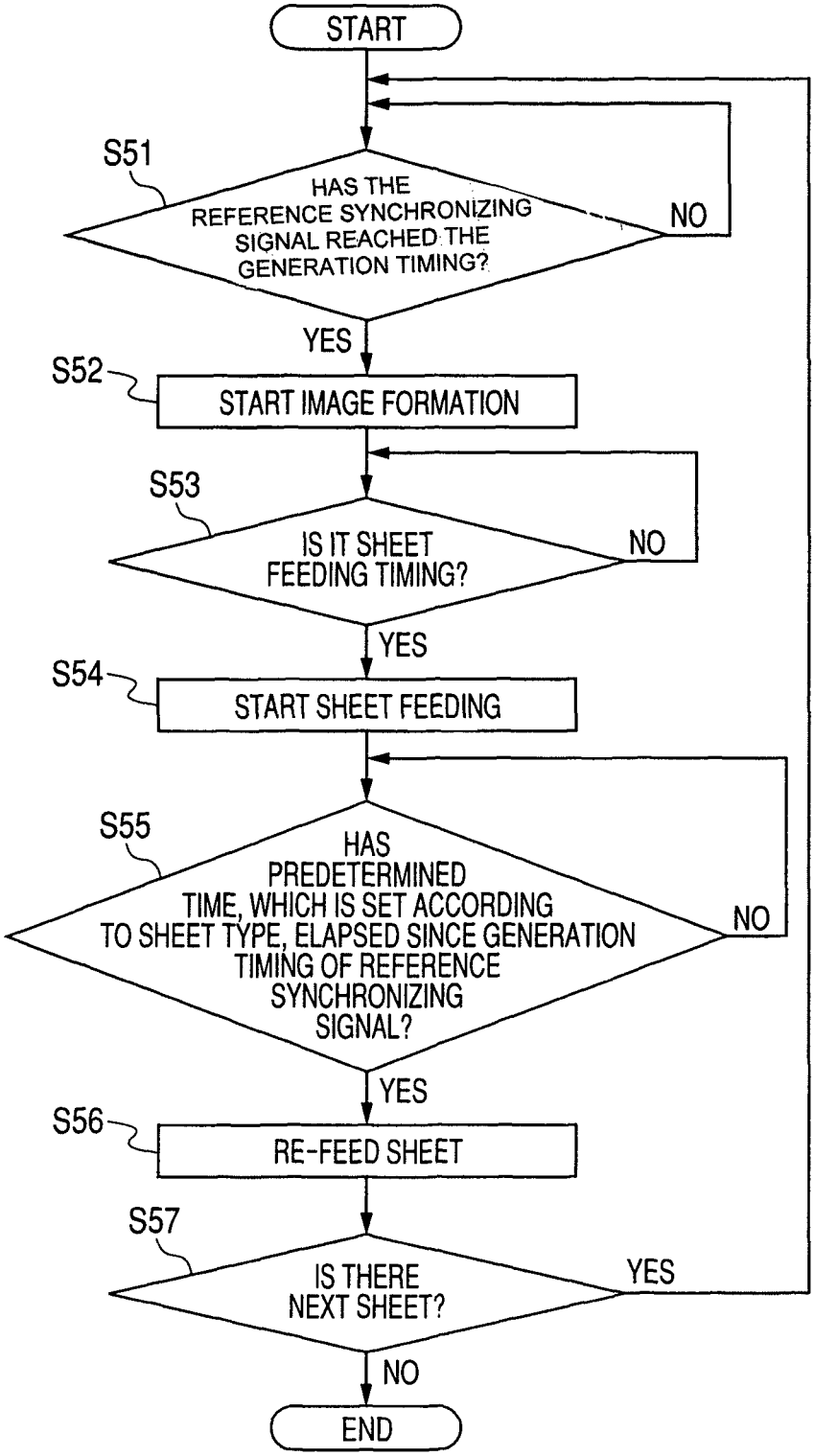
FIG. 5 is a flowchart for describing sheet feeding according to the first embodiment.

One of the features of the present invention, that is, control of adjusting the position of an image on the sheet S is described in detail. FIG. 1 is a partial sectional view illustrating the separation/feeding part and the registration part that are extracted from the image forming apparatus according to this embodiment. FIG. 3 is a block diagram illustrating a control system according to this embodiment. FIG. 4 is a flowchart for describing an operation of this embodiment. FIG. 5 is a flowchart related to sheet feeding according to this embodiment. FIG. 6 illustrates an example of a relationship among a basic weight of a sheet, a sheet size, and an image position shift amount.

As illustrated in FIG. 3, the control unit (CPU) 23 provided to the color laser printer 1 is connected to a registration roller drive motor 25, a transport roller drive motor 26, and a sheet feed roller drive motor 28 so as to output a signal to each thereof. The registration roller drive motor 25 drives the registration roller pair 76 serving as the registration part, the transport roller drive motor 26 drives the transport roller pair 75, and the sheet feed roller drive motor 28 drives the sheet feed roller 65*b*. Input to the control unit 23 are an image signal $d_1$ to be sent to the printer main body 1A, a signal (basic weight signal) $d_2$ for a sheet basic weight to be selectively input from an operation unit (not shown) included in the printer main body 1A, and a signal (size signal) $d_3$ for a sheet size. The transport roller pair 75 form a sheet alignment part for aligning a side of the leading edge of the sheet with a width direction thereof perpendicular to a transport direction of the sheet by bringing the sheet S to be transported into abutment against the nip portion between the stopped registration roller pair 76 to form a loop.

The control unit 23 includes a basic weight determination section 23*a*, a sheet length determination section 23*b*, a roller drive control section 23*c*, and a process control section 23*d*.

The basic weight determination section 23*a* determines whether or not the basic weight of the sheet selectively input from the operation unit (not shown) is normal.

The sheet length determination section 23*b* determines which of a first sheet length and a second sheet length a transport direction length Ls of the sheet S to be transported is. The first sheet length represents such a length of a sheet that a trailing edge side of the sheet can be subjected to a load imposed by the separation/feeding part 67 when the leading edge of the sheet reaches the registration roller pair 76. The second sheet length represents such a length of a sheet that the load imposed on the trailing edge side of the sheet by the separation/feeding part 67 when the leading edge of the sheet reaches the registration roller pair 76 is smaller than in the case of the first sheet length. In this embodiment, the first sheet length is such a length that the load can be imposed by the separation/feeding part 67 with the trailing edge side (right side of FIG. 1) of the sheet S being nipped by the nip portion of the separation/feeding part 67 when the leading edge (left side of FIG. 1) of the sheet S reaches the registration roller pair 76. The second sheet length is such a length that the trailing edge side of the sheet S cannot be nipped by the nip portion of the separation/feeding part 67 without the load being imposed on the trailing edge side of the sheet by the separation/feeding part 67 (or with the load being smaller than in the case of the first sheet length) when the leading edge of the sheet S reaches the registration roller pair 76. The sheet length determination section 23*b* determines which of the first sheet length ($L1+\alpha<Ls<L2$, $L2<Ls$ described later) and the second sheet length ($Ls<L1+\alpha$ described later) the transport direction length Ls of the sheet S is. If the basic weight determination section 23*a* determines that the basic weight of the sheet S based on the input basic weight signal $d_2$ is normal, the sheet length determination section 23*b* determines whether or not the transport direction length of the sheet S is the first sheet length, that is, which of first to third sheet sizes described later the sheet S has.

The roller drive control section 23*c* serving as the control unit performs the following control according to the determination performed by the sheet length determination section

23*b* so that the toner image on the intermediate transfer belt 31 can be transferred onto a predetermined position of the sheet S (proper position that does not impair the image). In order to change a transport operation performed by the registration roller pair 76, the roller drive control section 23*c* performs such control as to change the sheet re-feed timing between the case of the first sheet length and the case of the second sheet length. In other words, if the sheet length determination section 23*b* determines that the transport direction length of the sheet is the first sheet length, the roller drive control section 23*c* controls the sheet re-feed timing at the registration roller pair 76 to be earlier than in the case where the transport direction length of the sheet is the second sheet length. The sheet re-feed timing is a sheet re-feed timing at the registration roller pair 76 with respect to the toner image on the intermediate transfer belt 31 (with respect to the start of the image formation performed by the image forming portion 1B). The process control section 23*d* of the control unit 23 controls operations of the respective parts of the image forming portion 1B.

In this embodiment, if the length of the sheet S to be transported is such a length that the trailing edge side of the sheet S is nipped by the nip portion of the separation/feeding part 67 when the leading edge of the sheet S reaches the registration roller pair 76, the following control is performed. That is, as the transport direction length of the sheet S to be transported becomes larger, the roller drive control section 23*c* controls the registration roller pair 76 so that the timing at which the transport of the sheet S is started after the registration roller pair 76 temporarily stop the sheet S becomes earlier. Further, if the basic weight of the sheet S to be transported is equal to or larger than a predetermined basic weight, the roller drive control section 23*c* changes the timing at which the registration part starts re-transport (sheet re-feeding) according to the length of the sheet to be transported. If the basic weight of the sheet S to be transported is smaller than the predetermined basic weight (if normal), the above-mentioned timing at the registration part is not changed.

As illustrated in FIG. 1, the transport direction length of the sheet S is set as the transport direction length Ls of the sheet, and a transport distance from the nip portion of the separation/feeding part 67 to the nip portion between the registration roller pair 76 is set as a first transport distance L1. A transport distance from the nip portion between the registration roller pair 76 to the nip portion of the secondary transfer part 29 is set as a second transport distance Lt. A transport distance from the nip portion of the separation/feeding part 67 to the nip portion of the secondary transfer part 29 is set as a third transport distance L2. In this case, the third transport distance L2 is a sum of the first transport distance L1 and the second transport distance Lt, that is, the following expression is established.

$$L2=L1+Lt$$

In the color laser printer 1 according to this embodiment, as illustrated in a table of FIG. 6, the sheet used for the image formation has a basic weight corresponding to a range of 52 to 300 (g/m$^2$). In FIG. 6, the basic weight of the sheet is classified into settings of within a first basic weight range of 52 to 220 (g/m$^2$), within a second basic weight range of 221 to 256 (g/m$^2$), and within a third basic weight range of 257 to 300 (g/m$^2$). In this embodiment, the sheet within the first basic weight range of 52 to 220 (g/m$^2$) is referred to as "normal sheet".

If the transport direction length (referred to as "sheet size" in FIG. 6) Ls of the sheet is Ls<L1+α indicating the first sheet size, the image position shift amount is set to 0 (mm) for all the first basic weight range, the second basic weight range, and the third basic weight range. The value "a" represents a loop transport amount by which forced transport is performed into the nip portion between the registration roller pair 76 being stopped to form a loop for the purpose of the alignment of the sheet S. If the transport direction length Ls of the sheet is L1+α<Ls<L2 indicating the second sheet size, the image position shift amount is set to 0 (mm) within the first basic weight range, 0.3 (mm) within the second basic weight range, and 0.5 (mm) within the third basic weight range. If the transport direction length Ls of the sheet is L2<Ls indicating the third sheet size, the image position shift amount is set to 0 (mm) within the first basic weight range, 0.5 (mm) within the second basic weight range, and 0.8 (mm) within the third basic weight range.

Data regarding the first to third basic weight ranges and the first to third sheet sizes, which is shown in FIG. 6, is stored in the control unit 23 in advance. According to a determination result produced by the sheet length determination section 23*b*, the roller drive control section 23*c* performs appropriate determination and control so that the toner image formed on the intermediate transfer belt 31 can be transferred onto a predetermined position of the sheet.

With reference to FIGS. 1, 3, and 4, the control of adjusting the position of an image on the sheet S is described in detail. The control in the case of performing the sheet feeding (separation/feeding) from the manual feed tray 65 is described as a representative example.

A user sets a sheet S on the manual feed tray 65. In this case, the user selectively inputs the basic weight and the size of the sheet S from the operation unit (not shown) (Steps S1 to S3). When a print job is started on the color laser printer 1, image creation conforming to an image creation process (image forming process) described above is performed. After the image formation is started, sheet feeding is performed from the manual feed tray 65 based on a sheet feeding signal output at a desired timing, and the sheet S is transported to the transport roller pair 75. By bringing the sheet S into abutment against the stopped registration roller pair 76 to form a loop, the processing waits until the sheet re-feed timing with the leading edge of the sheet S aligned therewith and the skew feeding corrected.

The flowchart of FIG. 4 is referenced to describe setting of the sheet re-feed timing at the registration roller pair 76. When the basic weight is selectively input from the operation unit in Step S1, the basic weight determination section 23*a* determines based on the basic weight signal $d_2$ whether or not the input basic weight is normal (S2). If the basic weight determination section 23*a* determines that the basic weight is normal (that is, if the basic weight is a normal basic weight within the first basic weight range set in advance), the processing advances to Step S8, in which the sheet re-feed timing at the registration roller pair 76 serving as the registration part is set to a normal sheet re-feed timing.

If it is determined in Step S2 that the basic weight is not normal (if the basic weight is within the second or third basic weight range), the sheet length determination section 23*b* determines based on the size signal $d_3$ the sheet size selectively input by the user from the above-mentioned operation unit in Step S3. In Step S4, the sheet length determination section 23*b* determines whether or not the sheet size (paper length) is larger than an interval between the nip portion between the registration roller pair 76 and the nip portion of the separation/feeding part 67. If it is determined that the sheet size is not larger than the above-mentioned interval between the two nip portions (that is, that the transport direction length Ls corresponds to the first sheet size), the roller drive control section 23*c* sets the sheet re-feed timing at the registration roller pair 76 to the normal sheet re-feed timing without changing the sheet re-feed timing (S8).

If it is determined in Step S4 that the transport direction length Ls of the sheet is larger than the above-mentioned interval between the two nip portions (that is, that the transport direction length Ls of the sheet corresponds to any one of the second and third sheet sizes), the sheet length determination section 23*b* further performs the following determination. That is, the sheet length determination section 23*b* determines whether or not the transport direction length Ls of the sheet is larger than an interval between the nip portion of the secondary transfer part 29 and the nip portion of the separation/feeding part 67 (S5). If it is determined that the transport direction length Ls is smaller than the above-mentioned interval between the two nip portions (that is, the transport direction length Ls corresponds to the second sheet size), the processing advances to Step S9. A shift amount (change amount) with reference to the normal sheet re-feed timing is calculated (selected) from the basic weight and the size of the sheet S selectively input simultaneously with the start of the print job. In Step S10, the roller drive control section 23*c* calculates (selects) the shift amount to be controlled which corresponds to the basic weight determined in Step S2 and the transport direction length Ls of the sheet determined in Step S5. The roller drive control section 23*c* changes the sheet re-feed timing at the registration roller pair 76 serving as the registration part to a different setting.

If it is determined in Step S5 that the transport direction length Ls of the sheet is larger than the above-mentioned interval between the two nip portions (that is, that the transport direction length Ls corresponds to the third sheet size), the roller drive control section 23*c* calculates (selects) the shift amount (change amount) with reference to the normal sheet re-feed timing as follows. That is, in Step S6, the roller drive control section 23*c* calculates (selects) the shift amount (change amount) with reference to the normal sheet re-feed timing so as to correspond to the basic weight determined in Step S2 and the transport direction length Ls of the sheet determined in Step S5. The roller drive control section 23*c* changes the sheet re-feed timing at the registration roller pair 76 to a different setting (S7).

FIG. 5 is referenced to describe the control of the image formation and the sheet feeding including sheet re-feeding performed by the registration roller pair 76. The process control section 23*d* of the control unit 23 generates a reference synchronizing signal. The reference synchronizing signal is a signal for maintaining synchronization between the image forming portion 1B and sheet transport control. The reference synchronizing signal is issued at predetermined intervals in a case where an image is continuously formed on sheets. In the color laser printer 1 (image forming apparatus) according to this embodiment, an image is formed on 60 sheets per minute. Therefore, the reference synchronizing signal is issued every second.

In Step S51, when a generation timing of a reference synchronizing signal is reached, the process control section 23*d* controls the image forming portion 1B to start the image formation with respect to the photosensitive drums 11 (S52). Specifically, the image forming portion 1B starts to form electrostatic latent images on the photosensitive drums 11. In this embodiment, the photosensitive drums 11 and the intermediate transfer belt 31 rotate at a uniform rate. Therefore, a time required from the start of the image formation performed by the image forming portion 1B until the toner image formed on the intermediate transfer belt 31 by the image forming portion 1B reaches the secondary transfer position where the toner image starts to be transferred onto the sheet is the same in any case.

The roller drive control section 23*c* controls the sheet feed roller drive motor 28 so that the sheet feeding is started from the manual feed tray 65 by the sheet feed roller 65*b* and the separation roller 65*c* a predetermined time after the reference synchronizing signal is received from the process control section 23*d* (S53 and S54). The roller drive control section 23*c* controls the transport roller drive motor 26 so that the fed sheet is transported by the transport roller pair 75 until the leading edge of the sheet reaches the stopped registration roller pair 76. After the sheet fed by the sheet feed roller 65*b* reaches the transport roller pair 75, the sheet feed roller drive motor 28 is stopped, and the sheet is transported by the transport roller pair 75.

After that, as described with reference to FIG. 4, the roller drive control section 23*c* determines whether or not the sheet re-feed timing set according to the type of the sheet has been reached. The roller drive control section 23*c* determines whether or not a time set in such manner as described with reference to FIG. 4 has elapsed since the generation of the reference synchronizing signal (S55). When the sheet re-feed timing is reached, the roller drive control section 23*c* controls the registration roller drive motor 25 to perform the sheet re-feeding so as to start the rotation of the registration roller pair 76 (S56). After that, the presence/absence of the next sheet is determined. If the next sheet exists, the processing returns to Step S51, and if the next sheet does not exist, the processing is brought to an end (S57).

In this embodiment, the rotation of the registration roller pair 76 is started at the timing set according to the basic weight and the sheet length, and hence the toner image formed on the intermediate transfer belt 31 can be transferred onto the predetermined position of the sheet S (proper position that does not impair the image). Accordingly, the sheet S is sent to the secondary transfer part 29, and in the transfer position of the secondary transfer part 29, the toner image (image) is transferred onto the predetermined position (proper position) of the sheet S.

A specific example of the above-mentioned control is described below. If the basic weight of the sheet S is 271 ($g/m^2$) within the third basic weight range with the transport direction length Ls of the sheet corresponding to the second sheet size ($L1+\alpha<Ls<L2$), the following control is performed. That is, the roller drive control section 23*c* performs such control that the sheet re-feed timing at the registration roller pair 76 is set earlier than the sheet re-feed timing to transport the sheet of the first sheet size ($Ls<L1+\alpha$) by a time corresponding to 0.5 mm. In this embodiment, if a process speed at which the image is formed on the sheet of 271 ($g/m^2$) is set to 150 mm/sec, the sheet re-feed timing is set earlier than the normal sheet re-feed timing by 3.3 msec. The normal sheet re-feed timing represents the sheet re-feed timing in the case of the sheet of the first sheet size or within the first basic weight range. The change amount for changing the normal timing is prestored in the control unit 23 as in this embodiment by previously obtaining the change amount based on an experiment or the like.

This is because the transport efficiency after the sheet re-feeding performed by the registration roller pair 76 may change depending on whether or not the trailing edge of the sheet is engaged with the separation roller 65*c*. As a time during which the trailing edge of the sheet is engaged with the separation roller 65*c* after the sheet re-feeding performed by the registration part becomes longer, a time at which the leading edge of the sheet reaches the nip portion of the secondary transfer part 29 changes more greatly (that is, becomes later). As illustrated in FIG. 6, cases are classified under the following ranges.

$$Ls<L1+\alpha,\ L1+\alpha<Ls<L2,\ L2<Ls$$

In a case where a slip roller is used as a roller before the registration roller pair 76 or a case where a loop is not formed by the registration roller pair 76, a trailing edge position of the sheet S is decided irrespective of the loop transport amount $\alpha$, and hence the cases are classified under the following ranges.

$$Ls<L1,\ L1<Ls<L2,\ L2<Ls$$

After that, the sheet re-feeding is performed for the image signal $d_1$ at the timing changed by a time calculated for each case, the sheet S is transported to the secondary transfer part 29, and the toner image is transferred onto the predetermined position of the sheet S (proper position that does not impair the image).

In this embodiment, if the transport direction length of the sheet S to be transported is such a length larger than a predetermined length that the trailing edge side of the sheet S is nipped by the nip portion of the separation/feeding part 67 when the leading edge of the sheet S reaches the registration part, the roller drive control section 23*c* performs control as follows. That is, such control is performed that a timing at which the transport of the sheet S is started after the registration part temporarily stops the sheet S with respect to the start of the image formation performed by the image forming portion 1B is set earlier than in a case where the length of the sheet S to be transported is smaller than a predetermined length. In the case of Ls>L1 corresponding to the first sheet length, the roller drive control section 23*c* controls the sheet re-feed timing to be earlier than in the case of Ls<L1 corresponding to the second sheet length. In the case of Ls<L1+$\alpha$Ls>L2 corresponding to the first sheet size, the sheet re-feed timing is controlled to be earlier than in the case of Ls<L2 corresponding to the second sheet length. In the case of L1<Ls<L2 corresponding to the first sheet length, the roller drive control section 23*c* controls the sheet re-feed timing to be earlier than in the case of Ls<L1 corresponding to the second sheet length. In the case of Ls>L2 corresponding to the first sheet length, the sheet re-feed timing is controlled to be much earlier than in the case of L1<Ls<L2 corresponding to the first sheet length. In the case of Ls>L1+$\alpha$ corresponding to the first sheet length, the roller drive control section 23*c* controls the sheet re-feed timing to be earlier than in the case of Ls<L1+$\alpha$ corresponding to the second sheet length. In the case of L1+$\alpha$<Ls<L2 corresponding to the first sheet length, the roller drive control section 23*c* controls the sheet re-feed timing to be earlier than in the case of Ls<L1+$\alpha$ corresponding to the second sheet length. In the case of L2<Ls corresponding to the first sheet length, the sheet re-feed timing is controlled to be much earlier than in the case of L1+$\alpha$<Ls<L2 corresponding to the first sheet length.

In this embodiment, the sheet length determination section 23*b* determines which of the first sheet length and the second sheet length is the transport direction length Ls of the sheet S to be transported. According to the above-mentioned determination, the roller drive control section 23*c* controls the transport operation performed by the registration roller pair 76 to be changed between the case where the transport direction length is the first sheet length and the case where the transport direction length is the second sheet length so that the toner image on the intermediate transfer belt 31 can be transferred onto the predetermined position of the sheet S. If it is determined that the transport direction length of the sheet is the first sheet length, the roller drive control section 23*c* controls the sheet re-feed timing at the registration roller pair 76 with respect to the start of the image formation performed by the image forming portion 1B to be earlier than in the case of the second sheet length. Therefore, a satisfactory image can be formed on sheets having various types and different sizes without causing an increase in roller pressure of the registration roller pair 76. In a case where the basic weight is large, if a sheet is passing through the separation/feeding part 67 when the sheet is being transported by the registration roller pair 76, the separation/feeding part 67 becomes a load imposed on the sheet transported by the registration roller pair 76. The transport efficiency of the sheet transported by the registration roller pair 76 with the load imposed by the separation/feeding part 67 is degraded, to thereby delay the arrival of the sheet at the secondary transfer part. In this embodiment, the sheet re-feed timing is set in anticipation of the delay. In the case where the basic weight is large, and in the case of the sheet having such a length that the sheet is passing through the separation/feeding part 67 when the sheet is being transported by the registration roller pair 76, the sheet re-feeding is performed earlier in anticipation of the delay. Therefore, the toner image on the intermediate transfer belt 31 can be transferred onto the predetermined position of the sheet S irrespective of the basic weight or the length of the sheet.

A satisfactory image in which a displacement of the image in position is prevented can be formed while avoiding an impression left on the sheet during the transport which may be formed in a case where the pressure of the registration roller is raised in order to prevent the degradation of the transport efficiency of the registration roller pair 76 ascribable to the separation/feeding part 67.

If it is determined that the transport direction length is the first sheet length, the roller drive control section 23*c* controls the timing at which the registration roller pair 76 performs the sheet re-feeding after the image formation is started by the image forming portion 1B to be earlier than in the case of the second sheet length. Only by controlling the drive of the registration roller drive motor 25 to control the sheet re-feed timing at the registration roller pair 76, the toner image on the intermediate transfer belt can easily be transferred onto the predetermined position of the sheet S.

The above-mentioned embodiment is exemplified by such a mode that the sheet re-feed timing is changed only based on the sheet large in basic weight. However, in an apparatus in which the transport efficiency of the registration roller pair is degraded even for a plane sheet by the relationship of a load at a separation/feeding part or a transport force of a registration roller pair, the sheet re-feed timing may be changed even for the plane sheet according to the length of the sheet.

When the sheet re-feeding is performed by the registration part, in a case where a sheet transport speed is set higher than the process speed in order to increase a sheet feed jam margin, the sheet re-feed timing is not changed. Then, a deceleration timing for reducing the speed after the sheet re-feeding to the process speed is changed. This also produces the same effect. Control of a modified example is described in which the deceleration timing to the process speed is changed without changing the sheet re-feed timing.

Modified Example

Figure 7:
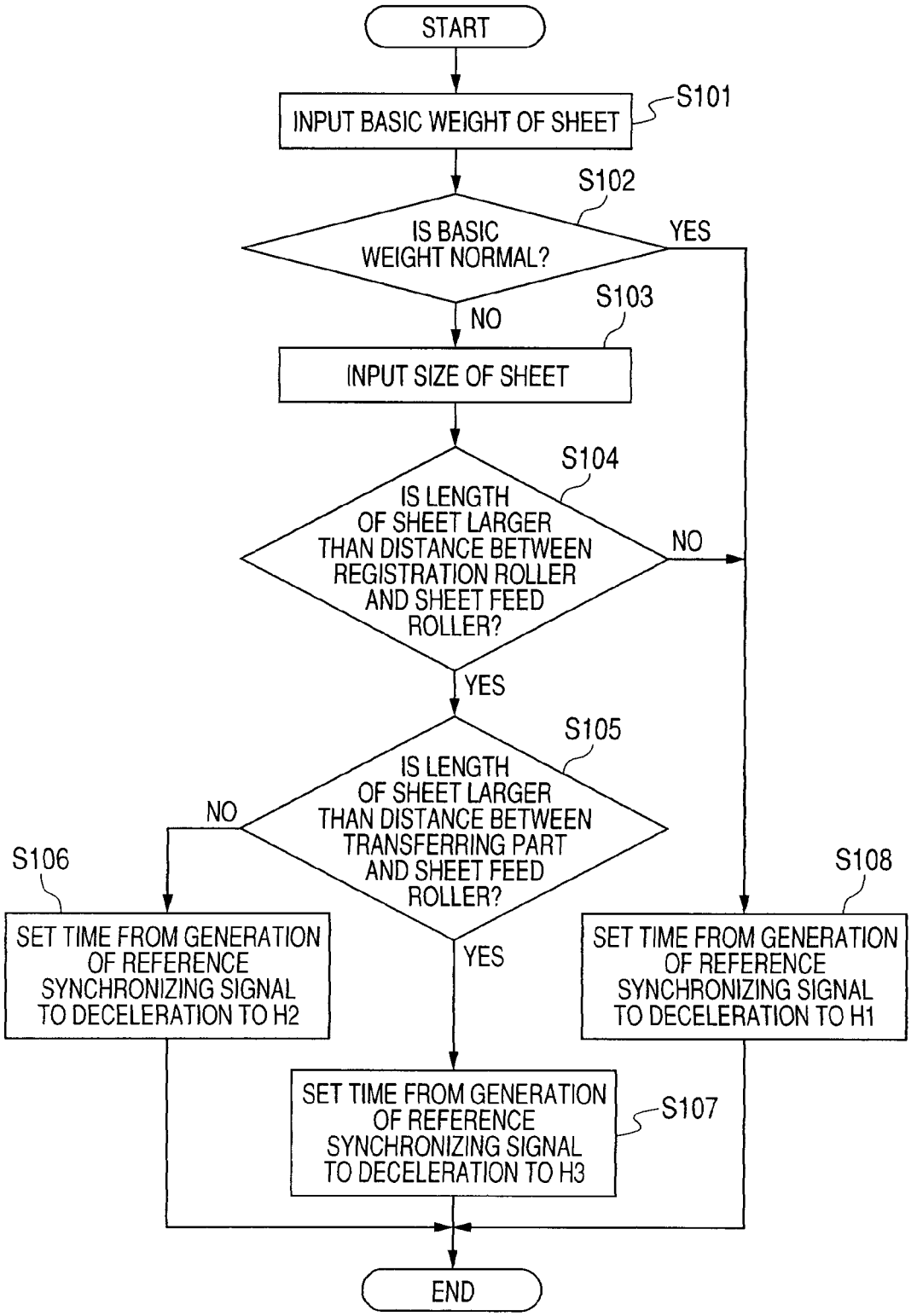
FIG. 7 is a flowchart for describing setting according to a modified example.

A flowchart of FIG. 7 is referenced to describe setting of the deceleration timing of the registration roller pair 76 according to this modified example. This modified example is different from the first embodiment in the control performed by the roller drive control section 23*c*, but the other parts are substantially the same. Therefore, FIGS. 1 to 3 and 6 are also referenced to give the description.

In this modified example, after transporting the sheet at a speed higher than a transfer-time speed (process speed), the registration roller pair 76 serving as the registration part are decelerated to the transfer-time speed before the transfer performed by the secondary transfer part 29. The roller drive control section 23*c* serving as the control unit according to this modified example performs the following control. That is, if the transport direction length of the sheet S to be transported is such a length larger than a predetermined length that the trailing edge side of the sheet S is nipped by the nip portion of the separation/feeding part 67 when the leading edge of the sheet S reaches the registration part, the control is performed as follows. That is, a timing at which the registration part is decelerated to the transfer-time speed with respect to the start of the image formation performed by the image forming portion 1B is controlled to be later than in the case where the length of the sheet S to be transported is smaller than the above-mentioned predetermined length. Specifically, if the sheet length determination section 23*b* determines that the transport direction length of the sheet is the first sheet length, the roller drive control section 23*c* performs control as follows. That is, the roller drive control section 23*c* controls so that the timing at which the registration roller pair 76 are decelerated to the above-mentioned transfer-time speed with respect to the start of the image formation performed by the image forming portion 1B is set to be later than in the case where the transport direction length of the sheet is the second sheet length. In this modified example, if the basic weight of the sheet S to be transported is equal to or larger than a predetermined basic weight, the roller drive control section 23*c* performs the following control according to the length of the sheet S to be transported. That is, the timing at which the registration part is decelerated to the transfer-time speed is changed according to the length of the sheet S to be transported, and if the basic weight of the sheet S to be transported is smaller than the predetermined basic weight, the timing at which the registration part is decelerated to the transfer-time speed is not changed.

When the basic weight is selectively input from the operation unit in Step S101, the basic weight determination section 23*a* determines based on the basic weight signal $d_2$ whether or not the input basic weight is normal (S102). If the basic weight determination section 23*a* determines that the basic weight is normal (that is, if the basic weight is a normal basic weight within the first basic weight range set in advance), the processing advances to Step S108, in which a time required by the registration roller pair 76 from the generation of the reference synchronizing signal to the deceleration is set to a normal time H1.

If it is determined in Step S102 that the basic weight is not normal (if the basic weight is within the second or third basic weight range), the sheet length determination section 23*b* determines based on the size signal $d_3$ the sheet size selectively input by the user from the operation unit in Step S103. In Step S104, the sheet length determination section 23*b* determines whether or not the sheet size (paper length) is larger than the interval between the nip portion between the registration roller pair 76 and the nip portion of the separation/feeding part 67. If it is determined that the sheet size is not larger than the above-mentioned interval between the two nip portions (that is, that the transport direction length Ls corresponds to the first sheet size), in Step S108, the roller drive control section 23*c* sets the time required by the registration roller pair 76 from the generation of the reference synchronizing signal to the deceleration is set to the normal time H1.

If it is determined in Step S104 that the transport direction length Ls of the sheet is larger than the above-mentioned interval between the two nip portions (that is, the transport direction length Ls of the sheet corresponds to any one of the second and third sheet sizes), the sheet length determination section 23*b* further performs the following determination. That is, the sheet length determination section 23*b* determines whether or not the transport direction length Ls of the sheet is larger than the interval between the nip portion of the secondary transfer part 29 and the nip portion of the separation/feeding part 67 (S105). If it is determined that the transport direction length Ls is smaller than the above-mentioned interval between the two nip portions (that is, the transport direction length Ls corresponds to the second sheet size), the processing advances to Step S106. In Step S106, the time required by the registration roller pair 76 from the generation of the reference synchronizing signal to the deceleration is set to a second time H2 representing a time longer than the normal time H1.

If it is determined in Step S105 that the transport direction length Ls of the sheet is larger than the interval between the nip portion of the secondary transfer part 29 and the nip portion of the separation/feeding part 67, the processing advances to Step S107 described below. In Step S107, the time required by the registration roller pair 76 from the generation of the reference synchronizing signal to the deceleration is set to a third time H3 representing a time longer than the normal time H1 and even longer than the second time H2.

Figure 8:
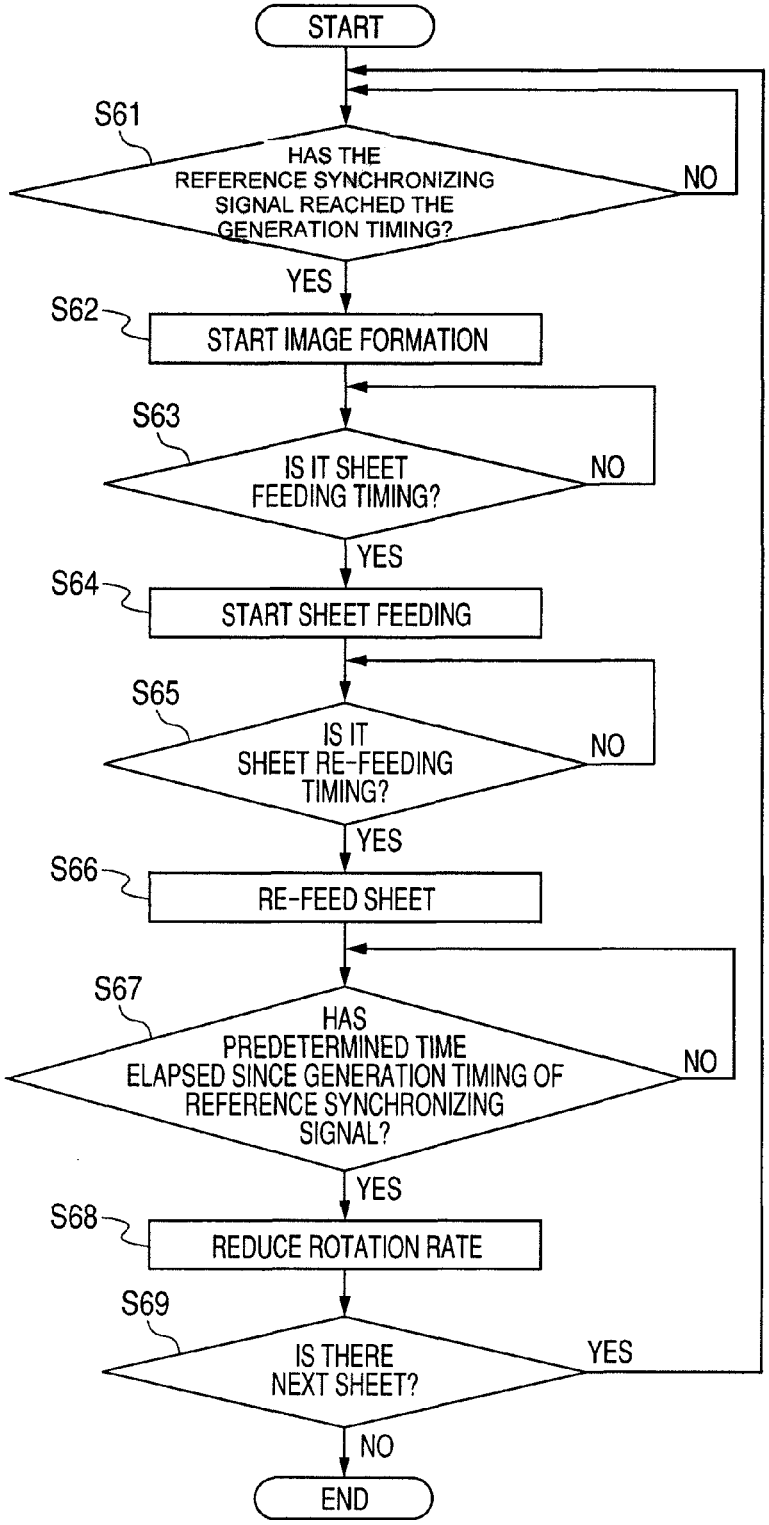
FIG. 8 is a flowchart for describing sheet feeding according to the modified example.

A flowchart of FIG. 8 is referenced to describe the control of the image formation and the sheet feeding including the transport performed by the registration roller pair 76 according to this modified example.

The process control section 23*d* of the control unit 23 generates a reference synchronizing signal. The reference synchronizing signal is issued at predetermined intervals in the case where an image is continuously formed on sheets. When the reference synchronizing signal occurs (S61), the process control section 23*d* simultaneously controls the image forming portion 1B to start the image formation with respect to the photosensitive drum 11 (S62). Specifically, the image forming portion 1B starts to form an electrostatic latent image on the photosensitive drum 11.

In Step S63, the roller drive control section 23*c* determines whether or not the sheet feed timing has been reached. In other words, the roller drive control section 23*c* determines whether or not a predetermined time defined as a time from the reception of the reference synchronizing signal from the process control section 23*d* to the start of sheet feeding has been elapsed. The roller drive control section 23*c* controls the sheet feed roller drive motor 28 so that the sheet feeding is started from the manual feed tray 65 by the sheet feed roller 65*b* and the separation roller 65*c* (S64). The roller drive control section 23*c* controls the transport roller drive motor 26 so that the sheet is transported by the transport roller pair 75 until the leading edge of the fed sheet reaches the stopped registration roller pair 76. After the sheet fed by the sheet feed roller 65*b* reaches the transport roller pair 75, the sheet feed roller drive motor 28 is stopped, and the sheet is transported by the transport roller pair 75.

After that, if the sheet re-feed timing is reached a predetermined time after the timing of the generation of the reference synchronizing signal (S65), the roller drive control section 23*c* controls the registration roller drive motor 25 so that the registration roller pair 76 start the rotation (S66). The sheet re-feed timing here is the same irrespective of the type of the sheet. The transport speed of the sheet when the sheet re-feeding is started is faster than the process speed (process rate).

After that, the roller drive control section 23*c* determines whether or not the deceleration timing set according to the type of the sheet as described with reference to FIG. 7 has been reached (S67). In other words, the roller drive control section 23*c* determines from the reference synchronizing signal whether or not a time set according to the type of the sheet has elapsed. When the deceleration timing is reached, the roller drive control section 23*c* controls the registration roller drive motor 25 so that the sheet is transported at the process rate by reducing the rotation rate of the registration roller pair (S68). Also in this modified example, the sheet S is sent to the secondary transfer part 29, and in the transfer position of the secondary transfer part 29, the toner image (image) can be transferred onto the predetermined position (proper position) of the sheet S. After that, the presence or absence of the next sheet is determined. If the next sheet exists, the processing returns to Step S61, and if the next sheet does not exist, the processing is brought to an end (S69).

Described so far is the image forming apparatus in which the basic weight and the size are selectively input. Alternatively, in a case where a media sensor capable of measuring the basic weight, thickness, stiffness, and the like of a sheet or a sheet length detection part for measuring a transport direction size of the sheet is provided within the image forming apparatus, the following become possible. That is, the image forming apparatus is also configured to be able to calculate the image position shift amount based on detection results of the media sensor or the sheet length detection part.

In the first embodiment and the modified example described above, such control can be performed that information on the type of a sheet is added to the control of the transport speed of the sheet before the sheet reaches the transfer position. The information on the type of the sheet includes at least one of the basic weight, stiffness, thickness, laid property, surface property, and density of the sheet. This can also be applied to second and third embodiments described later.

In a case where multiple equivalents of the separation/feeding part 67, that is, multiple separation/feeding parts formed of the sheet feed rollers 61*a*, 62*a*, 63*a*, and 64*a*, the sheet feed/transport rollers 61*b*, 62*b*, 63*b*, and 64*b*, and the separation rollers 61*c*, 62*c*, 63*c*, and 64*c*, are provided in multiple positions, the following configuration is also possible. That is, in the case where the separation/feeding parts are provided in multiple positions, a configuration in which speed control is performed in order to correspond to each of the separation/feeding parts (in order to correspond to sheet feed stages) is also possible. If the sheet feed stage is changed, the number of transport roller pairs located between the nip portion between the registration roller pair 76 and the nip portion of the separation/feeding parts increases, and the transport path changes to thereby change a guiding resistance, which naturally causes a change in transport efficiency. Therefore, the image position shift amounts are individually set in correspondence with the sheet feed stages. This can be applied not only to the first embodiment and the modified example described above but also to the second and third embodiments described later.

In this modified example, if the length of the sheet S to be transported is such a length that the trailing edge side of the sheet S is nipped by the nip portion of the separation/feeding part 67 when the leading edge of the sheet S reaches the registration roller pair 76, the control is performed as follows. That is, as the transport direction length of the sheet S to be transported becomes larger, the roller drive control section 23*c* controls the registration roller pair 76 so that the timing to decelerate to the transfer-time speed becomes later. If the length of the sheet S is larger than the transport distance from the separation/feeding part 67 to the secondary transfer part (transfer position) 29, the control is performed as follows. That is, the roller drive control section 23*c* controls the registration roller pair 76 so that the timing at which the registration roller pair 76 is decelerated to the transfer-time speed with respect to the start of the image formation performed by the image forming portion 1B becomes later than in the case where the sheet length is smaller than the transport distance from the separation/feeding part 67 to the transfer position.

Second Embodiment

As the second embodiment of the present invention, the control of adjusting the position of an image on the sheet S in the color laser printer 1 including a post-registration sheet detection part SN between the registration roller pair 76 and the secondary transfer part is described. This embodiment is different from the first embodiment in the control performed by the control unit 23 because the post-registration sheet detection part SN is provided between the registration roller pair 76 and the secondary transfer part 29. The other parts of this embodiment are substantially the same as those of the first embodiment. Therefore, this embodiment is described with reference to FIGS. 2 and 3 in addition to FIGS. 9 and 10.

Unlike the first embodiment, this embodiment presupposes the use of the sheets having the second sheet length and the first sheet length representing such a length that the trailing edge of the sheet is left at the separation/feeding part 67 when being transported by the registration roller pair 76. However, also in this embodiment, the first sheet length still represents such a length that the load is imposed on the trailing edge side of the sheet by the separation/feeding part 67 when the leading edge of the sheet reaches the registration roller pair 76. Further, the second sheet length still represents such a length that the load imposed on the trailing edge side of the sheet by the separation/feeding part 67 when the leading edge of the sheet reaches the registration roller pair 76 is smaller than in the case of the first sheet length.

In this embodiment, if the transport direction length of the sheet S to be transported is larger than the transport distance from the nip portion of the separation/feeding part 67 to the post-registration sheet detection part SN, the roller drive control section 23*c* performs the following control. That is, the registration roller pair 76 are controlled so that the timing to decelerate to the transfer-time speed after the post-registration sheet detection part SN detects the leading edge of the sheet S becomes later than in the case where the transport direction length is smaller than the transport distance from the nip portion of the separation/feeding part 67 to the post-registration sheet detection part SN. In this embodiment, if the basic weight of the sheet S to be transported is equal to or larger than a predetermined basic weight, the roller drive control section 23*c* performs the following control according to the length of the sheet S to be transported. That is, the timing at which the registration roller pair 76 are decelerated to the transfer-time speed is changed according to the length of the sheet S to be transported, and if the basic weight of the sheet S is smaller than the predetermined basic weight, the timing at which the registration roller pair 76 are decelerated to the transfer-time speed is not changed.

Sheet Transport Process

Figure 9:
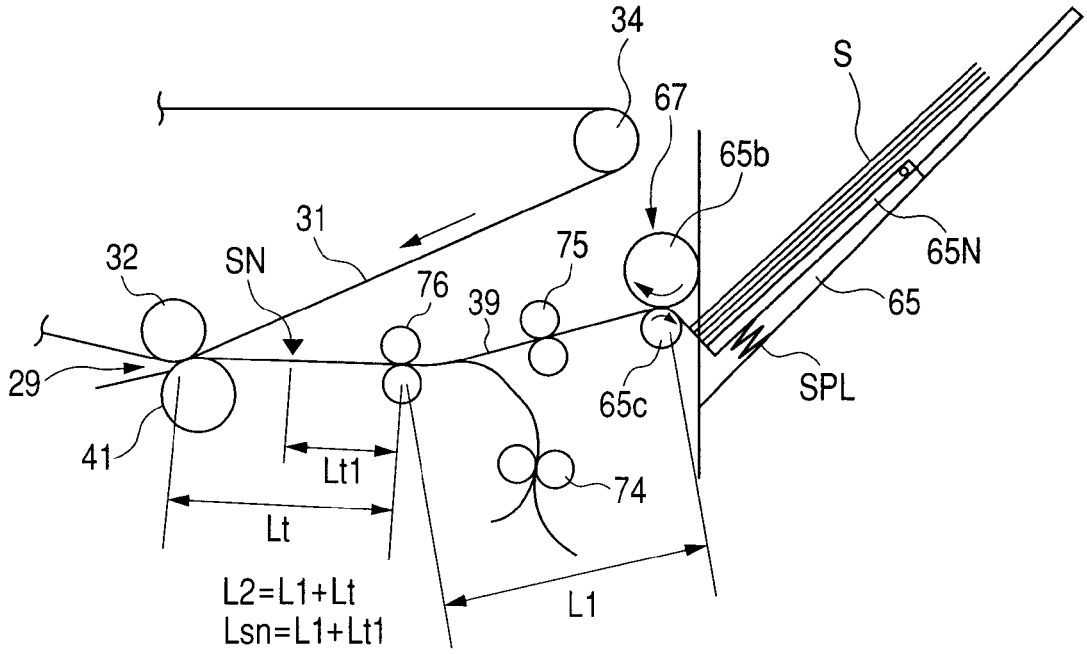
FIG. 9 is a partial sectional view illustrating a separation/feeding part and a registration part that are extracted from an image forming apparatus according to a second embodiment of the present invention.

According to the configuration of this embodiment, the transport speed at the time when the leading edge of the sheet passes through the registration roller pair 76 is set higher than the transfer-time speed (process speed) at the time of the transfer performed by the secondary transfer part 29 and is reduced to the above-mentioned transfer-time speed by the time of the transfer performed by the secondary transfer part 29. Also in this embodiment, as illustrated in FIGS. 2 and 9, the sheets S are contained in the sheet feeding cassettes 61 to 64 and the manual feed tray 65 by being stacked thereon, and the sheet feeding is performed by each of the sheet feed rollers 61*a*, 62*a*, 63*a*, 64*a*, and 65*b* in synchronization with an image forming timing. The sheet S sent out by the separation/feeding part 67 formed of the sheet feed roller 65*b* and the separation roller 65*c* passes through the transport path 39 and is transported to the registration roller pair 76.

In this embodiment, the roller drive control section 23*c* controls the transport speed of the sheet transported to the registration part and the transport speed at the time when the leading edge of the sheet passes through the registration part to become higher than the transfer-time speed at the time of the transfer performed by the secondary transfer part 29 in order to increase the sheet feed jam margin. The roller drive control section 23*c* controls the transport speed set higher than the transfer-time speed to be reduced to the transfer-time speed (process speed) by the time of the transfer performed by the secondary transfer part 29. As illustrated in FIG. 9, the post-registration sheet detection part SN is arranged between the registration roller pair 76 and the secondary transfer part 29, and the post-registration sheet detection part SN forms a leading edge detection part for detecting the leading edge of the sheet S transported by the registration roller pair 76. The post-registration sheet detection part SN serving as the leading edge detection part detects the leading edge of the sheet S transported by the registration roller pair 76 toward the secondary transfer part 29, and the sheet transport speed is reduced to the transfer-time speed at a timing calculated by the roller drive control section 23*c*.

If the post-registration sheet detection part SN detects the leading edge of the sheet S earlier than a nominal time (set time set in advance), the deceleration to the process speed is performed earlier by the corresponding time. Then, if the post-registration sheet detection part SN detects the leading edge of the sheet S later than the nominal time, the deceleration to the process speed is performed later by the corresponding time. By the above-mentioned settings, such control is performed that the toner image (image) can be satisfactorily transferred onto the predetermined position of the sheet (proper position that does not impair the image). The secondary transfer part 29 is a toner image transfer nip portion with respect to the sheet S, which is formed of the inner secondary transfer roller 32 and the outer secondary transfer roller 41, and transfers the toner image onto the sheet transported in the above-mentioned steps by applying a predetermined pressurizing force and an electrostatic load bias. The image creation process, the secondary transfer process, and the subsequent processes of this embodiment are the same as those of the first embodiment described above, and hence description thereof is omitted.

Also in this embodiment, the basic weight determination section 23*a* is the same as that of the previous embodiment. The sheet length determination section 23*b* also determines the length of the sheet between the first sheet length that can cause the load to be imposed on the trailing edge side by the separation/feeding part 67 when the leading edge of the sheet reaches the registration part and the second sheet length corresponding to such a length that the load imposed on the trailing edge side by the separation/feeding part when the leading edge of the sheet reaches the registration part is smaller than in the case of the first sheet length. Specifically, the sheet length determination section 23*b* of this embodiment determines whether or not the transport direction length Ls of the sheet to be transported is larger than the transport distance from the nip portion of the separation/feeding part 67 to the post-registration sheet detection part SN.

If the sheet length determination section 23*b* determines that the transport direction length of the sheet to be transported is the first sheet length larger than the transport distance from the nip portion of the separation/feeding part 67 to the post-registration sheet detection part SN, the roller drive control section 23*c* serving as the control unit performs the following control. That is, the control is performed so that the deceleration timing to decelerate to the transfer-time speed after the post-registration sheet detection part SN detects the leading edge of the sheet becomes later than in the case where the transport direction length is determined to be the second sheet length smaller than the transport distance from the nip portion of the separation/feeding part 67 to the post-registration sheet detection part SN. If the sheet length determination section 23*b* determines that the transport direction length Ls of the sheet is larger than a transport distance Lsn from the nip portion of the separation/feeding part 67 to the post-registration sheet detection part SN, the roller drive control section 23*c* performs the following control. That is, upon the determination, the roller drive control section 23*c* causes the deceleration timing to decelerate to the transfer-time speed after the post-registration sheet detection part SN detects the leading edge of the sheet to become later than in a case where the transport direction length Ls is smaller than the transport distance Lsn from the nip portion of the separation/feeding part 67 to the post-registration sheet detection part SN.

Image Position Adjusting Control for a Sheet

Also in this embodiment, the transport direction length of the sheet S is set as the transport direction length Ls, and the transport distance from the nip portion of the separation/feeding part 67 to the nip portion between the registration roller pair 76 is set as the first transport distance L1. The transport distance from the nip portion between the registration roller pair 76 to the nip portion of the secondary transfer part 29 is set as the second transport distance Lt, and the transport distance from the nip portion of the separation/feeding part 67 to the nip portion of the secondary transfer part 29 is set as the third transport distance L2. In this embodiment, a transport distance from the nip portion between the registration roller pair 76 to the post-registration sheet detection part SN is set as a fourth transport distance Lt1. The third transport distance L2 is expressed as follows.

$$L2=L1+Lt$$

Assuming that a transport distance from the nip portion of the separation/feeding part 67 to the post-registration sheet detection part SN is a fifth transport distance Lsn, the following expression is established.

$$Lsn=L1+Lt1$$

Figure 10:
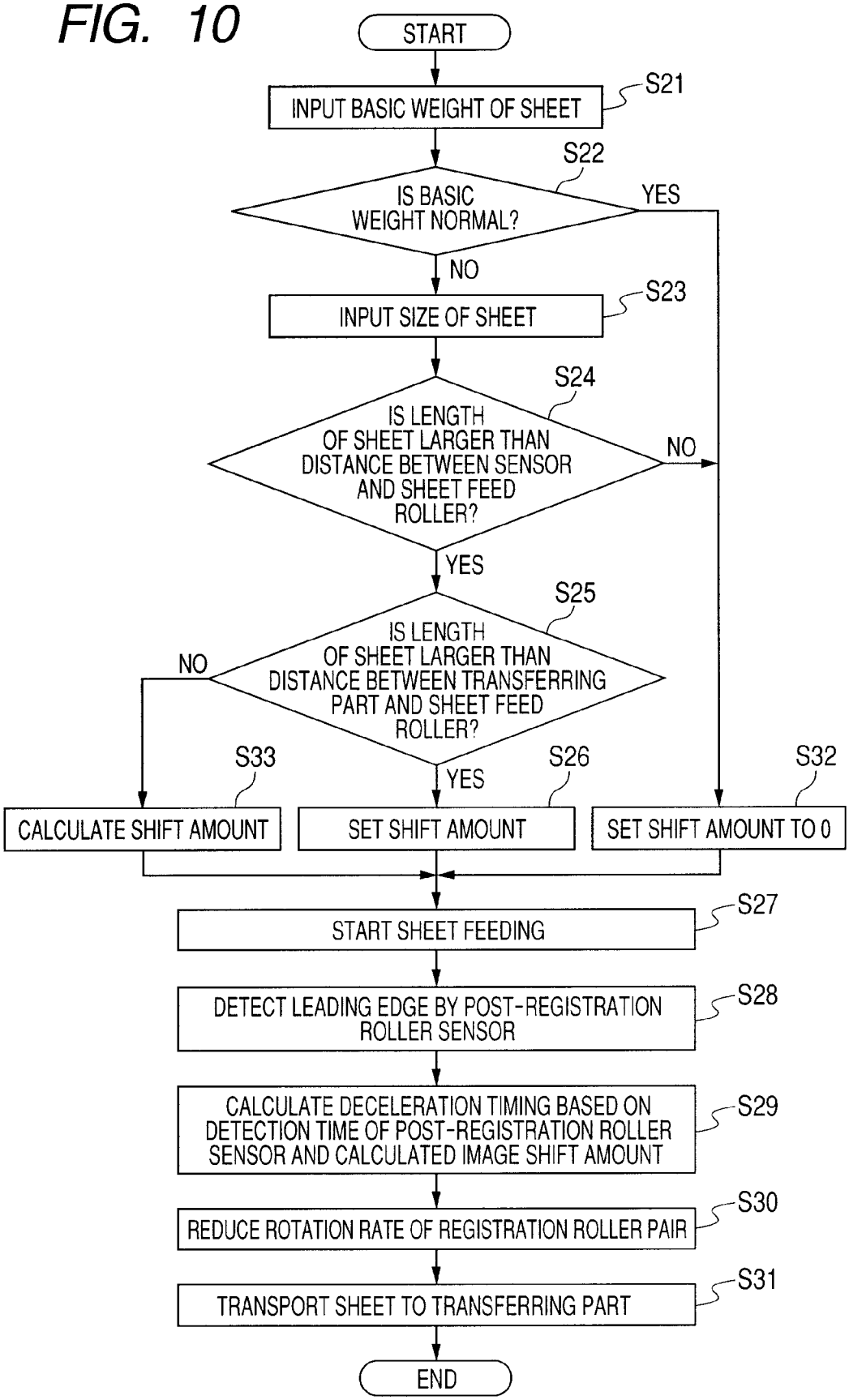
FIG. 10 is a flowchart for describing an operation of the second embodiment.

Hereinafter, FIGS. 6 and 10 are referenced to describe the control of adjusting the position of an image on the sheet S in detail. The control in the case of performing the sheet feeding from the manual feed tray 65 is described as a representative example. In the same manner as the first embodiment, the image position shift amount for the image position is calculated based on the basic weight and the size of the sheet S that are selectively input. In the case where a media sensor (not shown) and the sheet length detection part (not shown) are provided within the color laser printer 1, the image position shift amount for the image position may be calculated based on detection results thereof.

The image position shift amount is calculated because, as described above, the transport efficiency at the registration roller pair 76 may change depending on whether or not the trailing edge of the sheet is engaged with the separation roller 65*c*. In addition, as a time during which the trailing edge of the sheet is engaged with the separation roller 65*c* after the detection performed by the post-registration sheet detection part SN becomes longer, a time at which the leading edge of the sheet reaches the nip portion of the secondary transfer part 29 changes more greatly (that is, becomes later).

The cases are classified under the following ranges.

$Ls<Lsn$ (fourth sheet size), $Lsn<Ls<L2$ (fifth sheet size), $L2<Ls$ (sixth sheet size)

In this embodiment, when a print job is started on the color laser printer 1, the image creation conforming to the image creation process described above is performed. In response to the image signal $d_1$ obtained from the control unit 23, the sheet feeding is performed from the manual feed tray 65 based on a sheet feeding signal output at a desired timing, and the sheet S is transported to the transport roller pair 75. The transport speed of the sheet S transported to the registration roller pair 76 is set higher than the process speed in order to increase the sheet feed jam margin. After that, the leading edge of the sheet S transported to the secondary transfer part 29 is detected by the post-registration sheet detection part SN. In this case, it is calculated how many millimeters correspond to a time by which a detection timing at the post-registration sheet detection part SN is shifted from the nominal time. The transport speed is decelerated to the process speed (transfer-time speed) at such a timing as to shift a time at which the sheet S reaches the secondary transfer part 29 by a total sum of the amount corresponding to the above-mentioned shift in time and the image position shift amount calculated in the previous step. The sheet S thus transported has the toner image transported onto the predetermined position thereof (proper position) by the secondary transfer part 29.

In FIG. 10, when the basic weight is selectively input through the operation unit (S21), the basic weight determination section 23*a* determines whether or not the input basic weight is normal (S22). If the basic weight determination section 23*a* determines that the basic weight is normal, the processing advances to Step S32, in which the sheet re-feed timing at the registration roller pair 76 serving as the registration part is set to a normal timing. If it is determined in Step S22 that the basic weight is not normal (in a case of a thick sheet having a basic weight larger than the normal sheet), the sheet length determination section 23*b* performs the following determination based on the size signal $d_3$ obtained when the user performs a selective input through the operation unit in Step S23. That is, the sheet length determination section 23*b* determines whether or not the transport direction length of the sheet is larger than the fifth transport distance Lsn from the nip portion of the separation/feeding part 67 to the post-registration sheet detection part SN (S24). As a result, if it is determined that the transport direction length Ls of the sheet is not larger than the fifth transport distance Lsn (that is, that the transport direction length Ls of the sheet corresponds to Ls<Lsn), the roller drive control section 23*c* sets the image position shift amount (shift amount) to 0 (S32), and the processing advances to Step S27.

If it is determined in Step S24 that the transport direction length Ls of the sheet is larger than the fifth transport distance Lsn (that is, that the transport direction length Ls of the sheet corresponds to any one of Lsn<Ls<L2 and L2<Ls), the sheet length determination section 23*b* further performs the following determination. That is, the sheet length determination section 23*b* determines whether or not the transport direction length Ls of the sheet is larger than the interval between the nip portion of the secondary transfer part 29 and the nip portion of the separation/feeding part (S25). If it is determined that the transport direction length Ls is smaller than the above-mentioned interval between the two nip portions (that is, that the transport direction length Ls corresponds to Lsn<Ls<L2 (fifth sheet size)), the roller drive control section 23*c* sets the image position shift amount from the basic weight and the size of the sheet S selectively input simultaneously with the start of the print job (S33). The roller drive control section 23*c* sets the image position shift amount to be controlled which corresponds to the basic weight determined in Step S21 and the transport direction length Ls of the sheet determined in Step S25, and the processing advances to Step S27.

If it is determined in Step S25 that the transport direction length Ls of the sheet is larger than the interval between the nip portion of the secondary transfer part 29 and the nip portion of the separation/feeding part 67 (that is, L2<Ls), the control is performed as follows. That is, the roller drive control section 23*c* sets the image position shift amount to be controlled which corresponds to the basic weight determined in Step S22 and the transport direction length Ls of the sheet determined in Step S25 (S26), and the processing advances to Step S27.

In Step S27, the roller drive control section 23*c* controls the sheet feed roller drive motor 28 to be driven so that the sheet feeding (separation/feeding) is started by the sheet feed roller 65*b*. If the post-registration sheet detection part SN detects the leading edge of the sheet sent via the registration roller pair 76 (S28), the roller drive control section 23*c* calculates how many millimeters correspond to the time by which the detection timing at the post-registration sheet detection part SN is shifted from the nominal time (S29). The roller drive control section 23*c* calculates the deceleration timing based on the detection time of the post-registration sheet detection part SN and the set image position shift amount. The transport speed is decelerated at such a timing shifted from a timing, which is set for a case where the basic weight is normal and the sheet is transported at a nominal time instant without a shift in time, by a total sum of the amount corresponding to the above-mentioned shift in detection time and the image position shift amount set in Step S33 or S26 (S30). In other words, the transport speed faster than the process speed is decelerated to the process speed at the shifted timing (S30). The sheet S is transported to the secondary transfer part 29 (S31), and in the secondary transfer part 29, the toner image (image) is transferred onto the predetermined position (proper position) of the sheet S.

In this embodiment, if Ls>Lsn, the roller drive control section 23*c* controls the above-mentioned deceleration timing to become later than in the case of Ls<Lsn, and if Ls>L2, controls the above-mentioned deceleration timing to become later than in the case of Ls<L2. If Lsn<Ls<L2, the roller drive control section 23*c* controls the above-mentioned deceleration timing to become later than in the case of Ls<Lsn, and if L2<Ls, controls the above-mentioned deceleration timing to become later than in the case of Lsn<Ls<L2.

In this embodiment, the sheet length determination section 23*b* determines whether or not the transport direction length Ls of the sheet to be transported is larger than the transport distance from the nip portion of the separation/feeding part 67 to the post-registration sheet detection part SN. If the sheet length determination section 23*b* determines that the transport direction length Ls of the sheet is larger than the transport distance Lsn from the nip portion of the separation/feeding part 67 to the post-registration sheet detection part SN, the roller drive control section 23*c* performs the following control. That is, the roller drive control section 23*c* performs control so that the deceleration timing to decelerate to the transfer-time speed after the post-registration sheet detection part SN detects the leading edge of the sheet S becomes later than in the case where the transport direction length Ls is smaller than the transport distance Lsn from the nip portion of the separation/feeding part 67 to the post-registration sheet detection part SN. The second embodiment can also produce substantially the same effect as in the case of the first embodiment.

The image position can also be controlled by controlling signals sent to the registration roller drive motor 25 or the transport roller drive motor 26 to increase/reduce the sheet transport speed based on the detection results of the post-registration sheet detection part SN instead of controlling the deceleration timing.

Third Embodiment

Described so far is such a mode that the image formation is started simultaneously with the reference synchronizing signal and where the sheet re-feed timing at the registration roller pair 76 with respect to the start of the image formation and the transport speed at the registration roller pair 76 are changed, while in the third embodiment, the following control is performed. That is, the process control section 23*d* serving as the control unit performs the control in the following manner so that the toner image on the intermediate transfer belt 31 can be transferred onto the predetermined position of the sheet according to the determination performed by the sheet length determination section 23*b*. That is, if the transport direction length of the sheet S to be transported is such a length larger than a predetermined length that the trailing edge side of the sheet S is nipped by the nip portion of the separation/feeding part 67 when the leading edge of the sheet S reaches the registration part, the process control section 23*d* performs the following control. That is, the timing at which the image formation is started by the image forming portion 1B is controlled to be later than in the case where the length of the sheet S to be transported is smaller than the above-mentioned predetermined length. An image write start timing is controlled to be changed between the case where the transport direction length of the sheet S is the first sheet length and the case where the transport direction length is the second sheet length.

In this embodiment, the transport control of the registration roller pair 76 is not changed depending on the type of the sheet, and the same effect is produced by performing such control that the image write start (image formation start) timing is set later by the shift amount of FIG. 6. The image write start (image formation start) timing represents a timing at which an electrostatic latent image is formed on the photosensitive drum 11. In other words, the timing at which the image forming portion 1B starts the image formation is equal to the timing at which the electrostatic latent image starts to be formed on the photosensitive drum 11. If the sheet length determination section 23*b* determines that the transport direction length is the first sheet length, the process control section 23*d* performs such control that the timing at which the image forming portion 1B forms the electrostatic latent image on the photosensitive drum 11 becomes later than in the case where the transport direction length of the sheet is the second sheet length.

In this embodiment, in the case of such a length that the trailing edge side of the sheet S is nipped by the nip portion of the separation/feeding part 67 with a load imposed by the separation/feeding part 67 when the leading edge of the sheet S reaches the registration roller pair 76, the following control is performed. That is, as the transport direction length of the sheet S to be transported becomes larger, the process control section 23*d* performs such control that the timing at which the image forming portion 1B starts the image formation becomes later. In this embodiment, if the length of the sheet to be transported is larger than the transport distance from the separation/feeding part 67 to the secondary transfer part (transfer position) 29, the control is performed as follows. That is, the process control section 23*d* performs such control that the timing at which the image forming portion 1B forms the electrostatic latent image on the photosensitive drum 11 becomes later than in the case where the length of the sheet to be transported is smaller than the transport distance from the separation/feeding part 67 to the transfer position. If the basic weight of the sheet S to be transported is equal to or larger than a predetermined basic weight, the process control section 23*d* changes the timing at which the image forming portion 1B starts the image formation, and if the basic weight of the sheet S to be transported is smaller than the predetermined basic weight, does not change the timing at which the image forming portion 1B starts the image formation.

Described in detail below is such a mode that the image write start timing is changed according to the length of the sheet. Unlike the first embodiment, in this embodiment, the control unit according to the present invention corresponds to the process control section 23*d*. The other parts of this embodiment are substantially the same as those of the first embodiment. Therefore, FIGS. 2, 3, and 6 are also referenced for the description of this embodiment.

Figure 11:
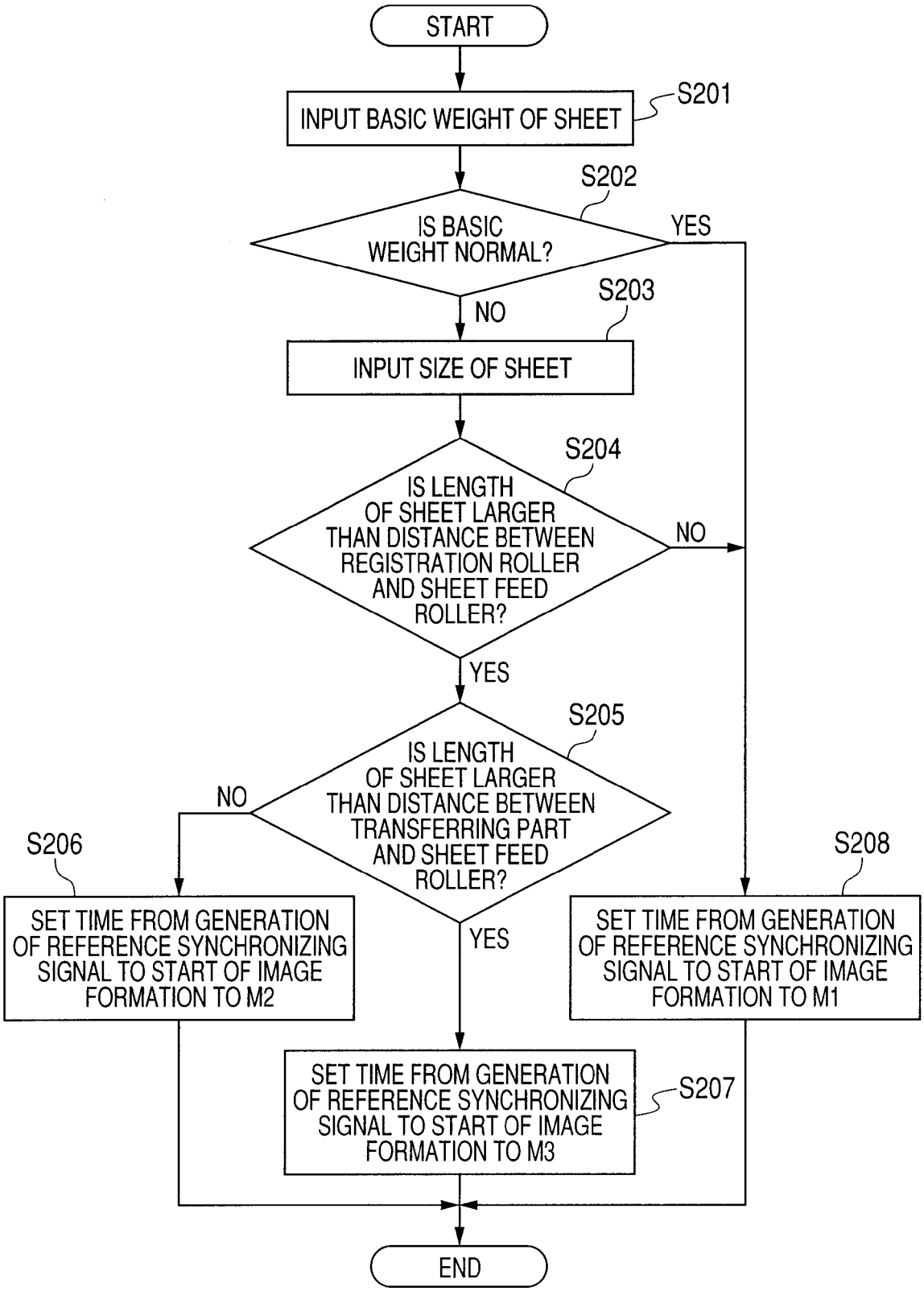
FIG. 11 is a flowchart for describing setting according to a third embodiment of the present invention.

A flowchart of FIG. 11 is referenced to describe setting of the start of the image formation according to this embodiment. When the basic weight is selectively input through the operation unit in Step S201, the basic weight determination section 23*a* determines based on the basic weight signal $d_2$ whether or not the input basic weight is normal (S202). If the basic weight determination section 23*a* determines that the basic weight is normal (that is, if the basic weight is the normal basic weight within the first basic weight range set in advance), the processing advances to Step S208, in which a delay time from the generation timing of the reference synchronizing signal to the start of the image formation is set to a normal time M1. In this embodiment, the normal time M1 is set to 0 (zero).

If it is determined in Step S202 that the basic weight is not normal (if the basic weight is within the second or third basic weight range), the sheet length determination section 23*b* determines based on the size signal $d_3$ the sheet size selectively input by the user through the above-mentioned operation unit in Step S203. In Step S204, the sheet length determination section 23*b* determines whether or not the sheet size (paper length) is larger than the interval between the nip portion between the registration roller pair 76 and the nip portion of the separation/feeding part 67. If it is determined that the sheet size is not larger than the above-mentioned interval between the two nip portions (that is, that the transport direction length Ls corresponds to the first sheet size), the processing advances to Step S208, in which the delay time from the generation timing of the reference synchronizing signal to the start of the image formation is set to the normal time M1.

If it is determined in Step S204 that the transport direction length Ls of the sheet is larger than the above-mentioned interval between the two nip portions (that is, that the transport direction length Ls of the sheet corresponds to any one of the second and third sheet sizes), the sheet length determination section 23*b* further performs the following determination. That is, the sheet length determination section 23*b* determines whether or not the transport direction length Ls of the sheet is larger than the interval between the nip portion of the secondary transfer part 29 and the nip portion of the separation/feeding part 67 (S205). If it is determined that the transport direction length Ls is smaller than the above-mentioned interval between the two nip portions (that is, that the transport direction length Ls corresponds to the second sheet size), the processing advances to Step S206. The delay time from the generation timing of the reference synchronizing signal to the start of the image formation is set to a second delay time M2 representing a time longer than the normal time M1.

If the sheet length determination section 23*b* determines in Step S205 that the transport direction length Ls of the sheet is larger than the interval between the nip portion of the secondary transfer part 29 and the nip portion of the separation/feeding part 67, the processing advances to Step S207. The delay time from the generation timing of the reference synchronizing signal to the start of the image formation is set to a third delay time M3 representing a time longer than the normal time M1 and even longer than the second delay time M2.

Figure 12:
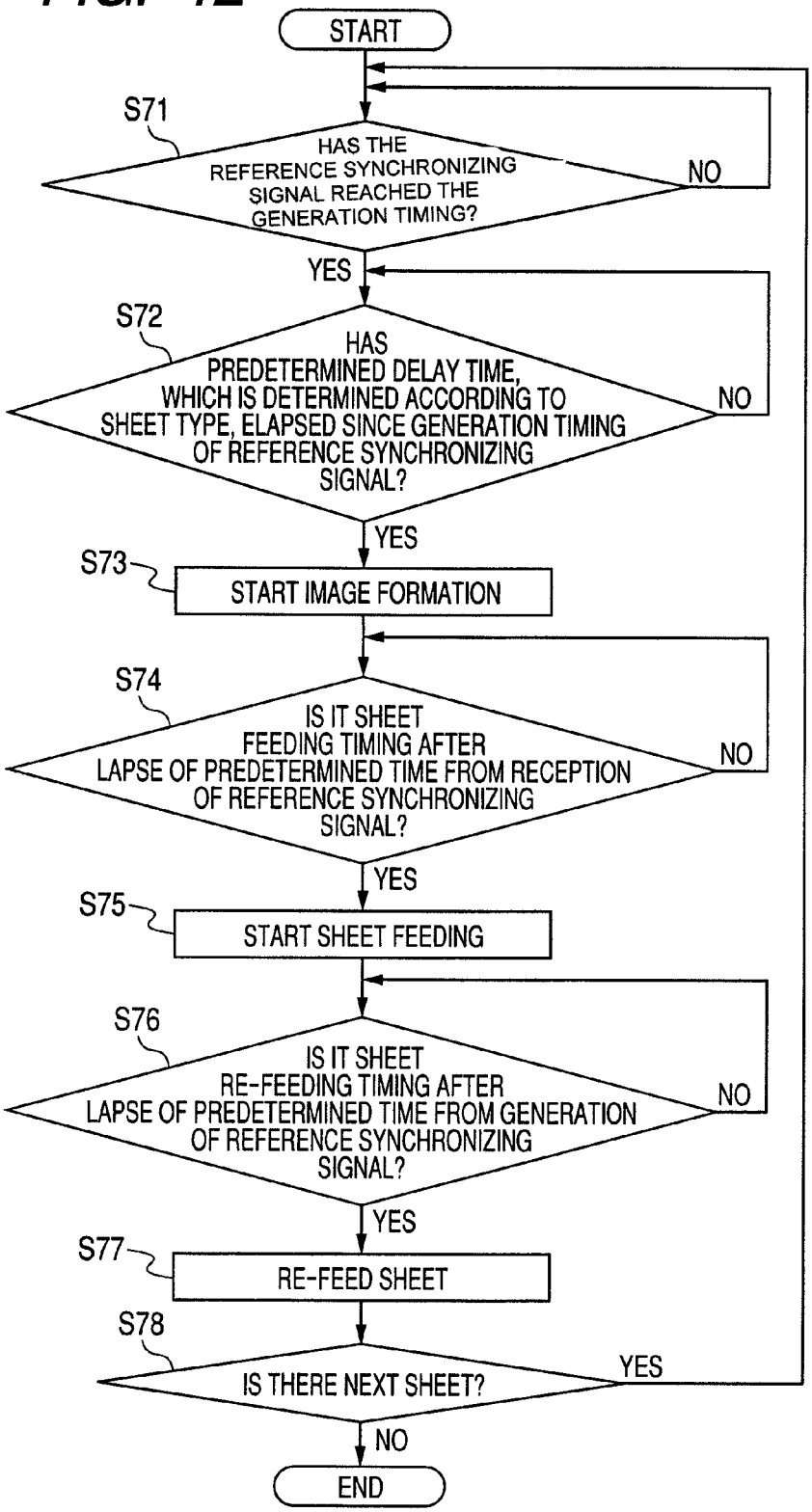
FIG. 12 is a flowchart for describing sheet feeding according to the third embodiment.

FIG. 12 is referenced to describe the control of the image formation and the sheet feeding including the transport performed by the registration roller pair 76 according to this embodiment. In Step S71, the process control section 23*d* of the control unit 23 generates a reference synchronizing signal. The reference synchronizing signal is issued at predetermined intervals in the case where an image is continuously formed on sheets. The process control section 23*d* determines whether or not the delay time set according to the type of the sheet has elapsed since the generation of the reference synchronizing signal (S72). If the delay time set according to the type of the sheet has elapsed, the process control section 23*d* controls the image forming portion 1B to start the image formation (S73). Specifically, the image forming portion 1B starts to form an electrostatic latent image on the photosensitive drum 11.

After a lapse of a predetermined time from reception of the reference synchronizing signal from the process control section 23*d* (S74), the roller drive control section 23*c* controls the sheet feed roller drive motor 28 so that the sheet feeding is started from the manual feed tray 65 by the sheet feed roller 65*b* and the separation roller 65*c* (S75). A time from the generation timing of the reference synchronizing signal to the start of the sheet feeding is the same irrespective of the type of the sheet.

The roller drive control section 23*c* controls the transport roller drive motor 26 so that the fed sheet is transported by the transport roller pair 75 until the leading edge of the sheet reaches the stopped registration roller pair 76. After the sheet fed by the sheet feed roller 65*b* reaches the transport roller pair 75, the sheet feed roller drive motor 28 is stopped, and the sheet is transported by the transport roller pair 75. After that, at the sheet re-feed timing after a lapse of a predetermined time from the generation timing of the reference synchronizing signal (S76), the roller drive control section 23*c* controls the registration roller drive motor 25 so that the registration roller pair 76 starts the rotation (S77). A time from the generation of the reference synchronizing signal to the sheet re-feeding is the same irrespective of the type of the sheet. After that, the presence or absence of the next sheet is determined. If the next sheet exists, the processing returns to Step S71, and if the next sheet does not exist, the processing is brought to an end (S78).

In this embodiment, the time from the start of the image formation performed by the image forming portion 1B to the sheet re-feeding performed by the registration roller pair 76 is changed according to the type of the sheet. This can prevent degradation in precision of the image formation ascribable to the degradation in transport efficiency of the registration roller pair 76 due to the load imposed by the separation/feeding part 67. Also in this embodiment, the sheet S is sent to the secondary transfer part 29, and in the transfer position of the secondary transfer part 29, the toner image (image) can be transferred onto the predetermined position (proper position) of the sheet S. The roller drive control section 23*c* controls the registration roller pair 76 to transport the sheet S to the secondary transfer part 29 serving as the transfer position every fixed time period.

Also in this embodiment, as in the first embodiment, the time from the start of the image formation performed by the image forming portion 1B to the sheet re-feeding performed by the registration roller pair 76 is changed according to the type of the sheet. In particular, in many image forming apparatuses that maintain a satisfactory timing even if image writing is started after the sheet re-feeding at the registration part, the image write start timing is decided with reference to the sheet re-feeding at the registration part. This embodiment is particularly effective for such image forming apparatuses.

In the embodiments except the second embodiment, that is, the first and third embodiments and the modified example, the first sheet length represents such a length that the trailing edge side of the sheet can be nipped by the nip portion of the separation/feeding part 67 with a load imposed by the separation/feeding part 67 when the leading edge of the sheet reaches the registration roller pair 76. The second sheet length represents such a length that the trailing edge side of the sheet cannot be nipped by the nip portion of the separation/feeding part 67 when the leading edge of the sheet reaches the registration roller pair 76. However, the present invention is not limited to the above-mentioned configuration. The first and third embodiments and the modified example described above can also produce the same operation effect as the second embodiment by similarly setting both the first and second sheet lengths as such a length that a load can be imposed by the separation/feeding part 67. Both the first and second sheet lengths represent such a length that the trailing edge side of the sheet can be nipped by the nip portion of the separation/feeding part 67 with a load imposed by the separation/feeding part 67 when the leading edge of the sheet reaches the registration roller pair 76. The first sheet length is larger than the second sheet length, and causes the load imposed on the trailing edge side of the sheet by the separation/feeding part 67 to be larger than in the case of the second sheet length. Even in the case where the first sheet length and the second sheet length are thus defined, the same operation effect can be produced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-195863, filed on Aug. 26, 1009, which is hereby incorporated by reference herein in its entirety.

What is claimed is:

1. An image forming apparatus, comprising:

an image bearing member configured to bear a toner image formed by an image forming portion;

a transfer part configured to transfer the toner image formed on the image bearing member onto a sheet;

a separation/feeding part configured to separate sheets stacked on a sheet stacking member and to feed the sheet while nipping the sheet;

a transport part configured to temporarily stop a sheet fed by the separation/feeding part, and then transport the sheet to the transfer part; and a control unit configured to control so that a timing to start transporting the sheet, after the transport part temporarily stops the sheet, with respect to a start of image formation performed by the image forming portion, is changed according to a length of the transported sheet in a transport direction of the sheet.

2. An image forming apparatus according to claim 1, wherein the control unit is configured to control so that, in a case of transporting a sheet having such a first length that a trailing edge side of the sheet is nipped by the separation/feeding part when the transport part transports the sheet, a timing to start transporting the sheet after the transport part temporarily stops the sheet with respect to the start of image formation performed by the image forming portion becomes earlier than in a case of transporting a sheet having such a second length smaller than the first length that the trailing edge side of the sheet is not nipped by the separation/feeding part when the transport part transports the sheet.

3. An image forming apparatus according to claim 1, wherein the control unit is configured to control so that, in a case of transporting a sheet having such a length that a trailing edge side of the sheet is nipped by the separation/feeding part when the transport part transports the sheet, a timing to start transporting the sheet after the transport part temporarily stops the sheet with respect to the start of image formation performed by the image forming portion becomes earlier as the length of the sheet to be transported in the transport direction of the sheet becomes larger.

4. An image forming apparatus according to claim 3, wherein the control unit is configured to control so that, in a case where the length of the sheet to be transported is larger than a transport distance from the separation/feeding part to the transfer part, the timing to start becomes earlier than in a case where the length of the sheet to be transported is smaller than the transport distance.

5. An image forming apparatus according to claim 1, wherein the control unit is configured to change the transporting operation of the transport part, when a basic weight of the sheet to be transported is equal to or larger than a predetermined basic weight, according to the length of the sheet to be transported, and the control unit is configured not to change the transporting operation of the transport part when the basic weight of the sheet to be transported is smaller than the predetermined basic weight.

* * * * *